US007342562B2

(12) United States Patent
Kawase et al.

(10) Patent No.: US 7,342,562 B2
(45) **Date of Patent: *Mar. 11, 2008**

(54) LIQUID CRYSTAL DRIVE DEVICE

(75) Inventors: Yasushi Kawase, Tachikawa (JP); Takesada Akiba, Hachioji (JP); Kazuya Endo, Higashimurayama (JP); Goro Sakamaki, Fuchu (JP)

(73) Assignee: Renesas Technology Corp., Tokyo (JP)

( * ) Notice: Subject to any disclaimer, the term of this patent is extended or adjusted under 35 U.S.C. 154(b) by 624 days.

This patent is subject to a terminal disclaimer.

(21) Appl. No.: 10/830,072

(22) Filed: Apr. 23, 2004

(65) Prior Publication Data

US 2004/0263446 A1 Dec. 30, 2004

(30) Foreign Application Priority Data

Jun. 30, 2003 (JP) ..... 2003-186652

(51) Int. Cl.
*G09G 3/36* (2006.01)

(52) U.S. Cl. ..... 345/87; 345/208

(58) Field of Classification Search ..... 345/87, 345/88, 89, 90, 91, 94, 95, 96, 97, 100, 208, 345/210

See application file for complete search history.

(56) References Cited

U.S. PATENT DOCUMENTS 5,751,278 A * 5/1998 Inamori et al. ..... 345/211
6,069,604 A * 5/2000 Verhulst ..... 345/97
6,567,062 B1 * 5/2003 Kudo et al. ..... 345/92
6,831,620 B1 * 12/2004 Nishikubo et al. ..... 345/87
7,053,875 B2 * 5/2006 Chou ..... 345/92
7,088,350 B2 * 8/2006 Miyazawa ..... 345/204
7,098,885 B2 * 8/2006 Kumada et al. ..... 345/96
7,109,984 B2 * 9/2006 Moon ..... 345/212
7,151,518 B2 * 12/2006 Fukumoto et al. ..... 345/96
7,176,868 B2 * 2/2007 Kudo et al. ..... 345/89

* cited by examiner

*Primary Examiner*—Richard Hjerpe
*Assistant Examiner*—Jean Lesperance
(74) *Attorney, Agent, or Firm*—Miles & Stockbridge P.C.

(57) ABSTRACT

By implementing reduction in power of common electrode voltages applied from a power source of a liquid crystal drive device to common electrode interconnects of a liquid crystal display panel, respectively, reduction in power consumption of the liquid crystal display panel as a whole is attained.

A VCOM operation waveform in a charging process from a second voltage VCOML to a first voltage VCOMH shows that a charging current Icha represents the sum of a charging current from VCOML to a reference voltage VCI, Icha1=Cp (VCI−VCOML)/Δt, and a charging current from the reference voltage VCI to the first voltage VCOMH, Icha2=Cp (VCOMH−VCI)/Δt. Accordingly, power consumed by Icha1 is the reference voltage VCI×Icha1, and power consumed by Icha2 is VCI×Icha2×2. Meanwhile, a discharging current at a time of discharging from the first voltage VCOMH to the second voltage VCOML is the sum of a discharging current from the first voltage VCOMH to the ground potential GND, Idis1=Cp (VCOMH−GND)/Δt, and a discharging current from the ground potential GND to the second voltage VCOML, Idis2=Cp (GND−VCOML)/Δt. Now, if converted in terms of power consumed at the reference voltage VCI, since Idis1 represents discharge to GND, power consumption thereby becomes zero. Then, consumed power due to the discharging current from the ground potential GND to the second voltage VCOML, Idis2, is VCI×Idis2.

20 Claims, 18 Drawing Sheets

LIQUID CRYSTAL DRIVE DEVICE

CROSS-REFERENCE TO RELATED APPLICATION

The present application claims priority from Japanese patent application JP 2003-186652 filed on Jun. 30, 2003, the contents of which are hereby incorporated by reference into this application.

BACKGROUND OF THE INVENTION

The present application relates to a liquid crystal drive device for driving a liquid crystal display device and more particularly, to a liquid crystal drive device capable of achieving reduction in power consumption.

A liquid crystal display device comprises a liquid crystal display panel, and a liquid crystal drive device supplying various signals and voltages for effecting display on the liquid crystal display panel. The liquid crystal display device currently in the mainstream of a display device for various types of electronic equipment is the so-called active-matrix type having active elements in a pixel circuit. Since thin-film transistors are generally used as the active elements, and the active elements are described as the thin-film transistors in the present specification.

This type of liquid crystal display device comprises a liquid crystal display panel having a plurality of source electrode interconnects extending in a first direction (for example, a longitudinal direction) on an inner face of an insulating substrate and juxtaposed in a second direction (for example, a transverse direction) intersecting the first direction, a plurality of gate electrode interconnects extending in the second direction and juxtaposed in the first direction, a thin-film transistor disposed at respective crossover points of the source electrode interconnects and the gate electrode interconnects, constituting a pixel respectively, a plurality of common electrode interconnects for applying a common electrode voltage (hereinafter referred to merely as "common voltage" as well) to common electrodes disposed through the intermediary of a liquid crystal layer, respectively, and an external terminal coupled in common to the common electrode interconnects, and a liquid crystal drive circuit supplying various signals and voltages for effecting display on the liquid crystal display panel. In this connection, the liquid crystal display device is not limited to one wherein the plurality of common electrode interconnects are coupled in common to the external terminal (also referred to as a common electrode terminal, or merely as a common electrode), outside a pixel region (display region) of the liquid crystal display panel but some liquid crystal display panel has common electrodes serving as a flat electrode in common to all pixels.

In display operation of the liquid crystal display device, the thin-film transistor of the pixel selected by a select voltage applied to one of the gate electrode interconnects is turned on, and an alignment direction of the liquid crystal layer interposed between a pixel electrode and the common electrode, coupled to the thin-film transistor, is caused to change, thereby controlling a quantity of transmitted light or reflected light. The common voltage applied to the common electrode at this point in time is generated by use of a voltage boosted by a boost circuit. The above and other objects and novel features of the invention will more fully appear from the following detailed description when the same is read in conjunction with the accompanying drawings. Specific examples of a conventional liquid crystal display device and a conventional liquid crystal drive device for driving the same, respectively, are described later in contrast with the present invention under the item "DETAILED DESCRIPTION OF THE PREFERRED EMBODIMENTS".

SUMMARY OF THE INVENTION

Particularly with a portable terminal using a cell as a power source, lower power consumption thereof has since become an important factor. For example, a common voltage (hereinafter referred to also as "VCOM") applied to an external terminal (referred to also as a common electrode CT) coupled in common to a plurality of common electrode interconnects undergoes a change (charging/discharging) between a certain reference voltage (for example, a low potential "VCOML") and another reference voltage (for example, a high potential "VCOMH") generated by a boost circuit. Consequently, power consumption in the course of common electrodes being charged or discharged is large, thereby creating one of factors hindering implementation of reduction in power consumption of a liquid crystal display device as a whole.

It is therefore an object of the invention to implement reduction in power of common electrode voltages applied to the common electrode interconnects, respectively, by a liquid crystal drive device, to thereby achieve reduction in power consumption of the liquid crystal display device as a whole.

A summary of a representative embodiment of the invention, disclosed herein, will be briefly described as follows.

To achieve the above-described object, the invention provides a liquid crystal drive device for driving one sheet of liquid crystal panel, the liquid crystal drive device comprising a power source circuit having a first terminal to which a first reference voltage VCC (power source voltage for a logic system) is supplied, a second terminal to which a second reference voltage GND (ground potential) is supplied, a third terminal to which a third reference voltage (power source voltage VCI for an analog system) is supplied, and a fourth terminal (VCOM output terminal) coupled to an external terminal of the liquid crystal display panel, wherein a first voltage generation circuit for generating a first voltage (VCOMH) higher than the first reference voltage; and a second voltage generation circuit for generating a second voltage (VCOML) lower than the second reference voltage are coupled to the first terminal and the second terminal, respectively.

With the liquid crystal drive device according to the invention, control is preferably effected such that a voltage (a common voltage VCOM) supplied to the fourth terminal is changed from the second voltage (VCOML) to the third reference voltage (VCI) and subsequently, changed form the third reference voltage (VCI) to the first voltage (VCOMH).

The liquid crystal drive device according to the invention may comprise a first voltage generation circuit (first boost circuit) for generating the first voltage (VCOMH) higher than the third reference voltage VCI), and a second voltage generation circuit (second boost circuit) for generating the second voltage (VCOML) lower than the second reference voltage (GND), provided at the first terminal and second terminal, respectively, controlling such that a voltage supplied to the fourth terminal may be changed from the first voltage (VCOMH) to the second reference voltage (GND) and subsequently, changed form the second reference voltage (GND) to the second voltage (VCOML).

Further, the invention provides in its second aspect a liquid crystal drive device for driving two sheets of liquid crystal panel, that is, a first liquid crystal panel and a second liquid crystal panel, having a power source circuit comprising a first terminal to which a first reference voltage VCC is supplied, a second terminal to which a second reference voltage (GND) is supplied, and a third terminal to which a third reference voltage (VCI) is supplied. The liquid crystal drive device further comprises a voltage generation circuit coupled to the first terminal and second terminal, for generating the first voltage (VCOMH) higher than the first reference voltage (VCC) and the second voltage (VCOML) lower than the second reference voltage (GND), a first common voltage generation circuit coupled in common to a plurality of pixels of the first liquid crystal display panel, for generating a first common voltage (VCOM1), a second common voltage generation circuit coupled in common to the plurality of pixels of the second liquid crystal display panel, for generating a second common voltage (VCOM2), a fourth terminal for outputting the first common voltage (VCOM1), and a fifth terminal for outputting the second common voltage (VCOM2).

Further, when the first common voltage generation circuit or the second common voltage generation circuit generates the first common voltage (VCOM1) or the second common voltage (VCOM2), supplied to the fourth terminal or the fifth terminal, the first common voltage generation circuit or the second common voltage generation circuit controls such that the first common voltage (VCOM1) or the second common voltage (VCOM2) is changed form the second voltage (VCOML) to the third reference voltage (VCI), and subsequently, changed from the third reference voltage (VCI) to the first voltage (VCOMH).

Still further, the liquid crystal drive device according to the invention may comprise a common voltage generation circuit coupled to the external terminal, for generating common voltages, and when a potential on the external terminal makes a transition from a first potential of the first voltage (VCOMH) to a second potential of the second voltage (VCOML) different from the first potential, the common voltage generation circuit may form a voltage waveform having an inflection point at a third potential point between the first potential and the second potential.

It is to be pointed out that the invention is obviously not limited to the above configurations and configurations described hereinafter with reference to the embodiments of the invention, and that various changes and modifications may be made in the invention without departing from the spirit and scope thereof.

DETAILED DESCRIPTION OF THE PREFERRED EMBODIMENTS

Embodiments of the invention are described in detail hereinafter with reference to the accompanying drawings for the embodiments.

Figure 1:
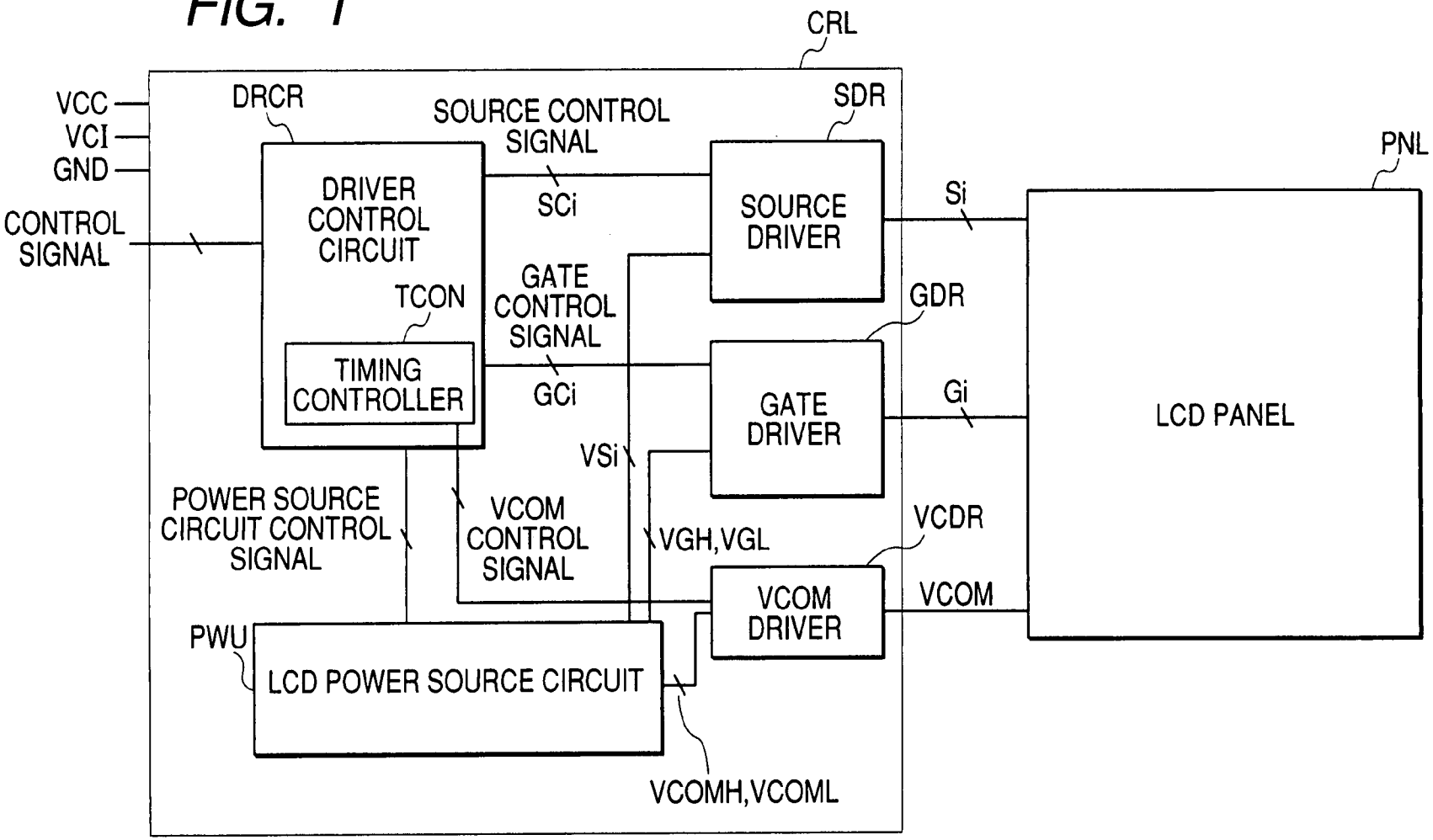
FIG. 1 is a block diagram showing one configuration example of an embodiment of a liquid crystal drive device according to the invention.

FIG. 1 is a block diagram showing one configuration of an embodiment of a liquid crystal drive device according to the invention by way of example. In FIG. 1, various signals and voltages for display are supplied from a liquid crystal drive device CRL to a liquid crystal display panel PNL denoted by LCD panel. As main signals supplied from the liquid crystal drive device CRL to the liquid crystal display panel PNL, only a source signal (display data) Si, a gate signal (scanning signal) Gi, and a common electrode voltage VCOM are shown herein.

The liquid crystal drive device CRL receives display signals to be displayed on the liquid crystal display panel, various clocks, and timing signals such as vertical, horizontal, and synchronizing signals, and so forth, from external signal sources, respectively. In FIG. 1, these signals and voltages are denoted by control signals. Further, the liquid crystal drive device CRL has a first terminal to which a first reference voltage VCC (power source voltage for a logic system) is supplied, a second terminal to which a second reference voltage GND (ground potential) is supplied, and a third terminal to which a third reference voltage VCI (power source voltage for an analog system) is supplied, which are provided on the input side thereof.

Further, the liquid crystal drive device CRL has a fourth terminal VCOM (VCOM output terminal) coupled to the liquid crystal display panel PNL. As a result of miniaturization in the process of fabricating a semiconductor integrated circuit, elements have since decreased in size, resulting in lower voltage resistance of elements for the logic system, so that the first reference voltage VCC is generally lower than the third reference voltage VCI. There is a case where the third reference voltage VCI is stabilized with precision higher than that for the first reference voltage VCC because the third reference voltage VCI is for generating a voltage for driving the liquid crystal display panel PNL although the invention is not particularly limited thereto. Accordingly, the first reference voltage VCC may be generated by lowering voltage from the third reference voltage VCI. That can reduce the number of terminals to thereby implement reduction in cost. For brevity, the terminals are denoted by respective signal names or voltage names thereof herein.

The liquid crystal drive device CRL comprises a source driver SDR, a gate driver GDR, a common electrode driver VCDR, a driver control circuit DRCR incorporating a timing controller TCON, and a LCD power source circuit PWU.

The control signals (the display signals, various clocks, and timing signals such as vertical, horizontal, and synchronizing signals, and so forth) received from the external signal sources, respectively, are processed by the driver control circuit DRCR, a source control signal SCi containing the display data is supplied to the source driver SDR, and a gate control signal GCi for generating the scanning signal is supplied to the gate driver GDR, whereupon the source signal Si and the gate signal (scanning signal) Gi are applied to a source electrode interconnect and a gate electrode interconnect of the liquid crystal display panel PNL, respectively.

Meanwhile, the LCD power source circuit PWU generates a first common voltage VCOM1 and a second common voltage VCOM2 from the first reference voltage VCC, second reference voltage GND, and third reference voltage VCI, on the basis of a power source circuit control signal and a VCOM control signal, received from the driver control circuit DRCR, sending out the first common voltage VCOM1 and second common voltage VCOM2 to the common electrode driver VCDR. The common electrode driver VCDR is controlled by a common electrode control signal (the VCOM control signal) delivered from the timing controller TCON, thereby applying a common voltage to a common electrode interconnect (common interconnect) of the liquid crystal display panel PNL.

The liquid crystal drive device CRL in FIG. 1 may be formed on a single semiconductor substrate such as a single crystal silicon although the invention is not limited thereto. With this constitution, I/O buffer and so forth can be shared, thereby achieving reduction in the number of components externally attached and reduction in a total area of the liquid crystal drive device CRL. Further, with the liquid crystal drive device CRL in FIG. 1, the driver control circuit DRCR and the rest may be separated from each other so as to be individually formed on a single semiconductor substrate. With this constitution, use of a high voltage resistant process becomes unnecessary in a control logic part during a fabrication process, thereby enabling reduction in cost. Still further, with the liquid crystal drive device CRL in FIG. 1, the LCD power source circuit PWU and the rest may be separated from each other so as to be individually formed on a single semiconductor substrate. With this constitution, a power source can be shared by various liquid crystal display panels PNLs while the rest can be variously applied to the liquid crystal display panels PNLs.

Furthermore, with the liquid crystal drive device CRL in FIG. 1, only the gate driver may be separated from the rest and the gate driver and the rest may be formed individually on a single semiconductor substrate. With this, a gate driver adapted to a liquid crystal display panel PNL can be applicable, and when a type of liquid crystal display panel with a gate driver assembled thereon is adopted, an area of the liquid crystal drive device CRL can be reduced to an extent of an area of the gate driver. Such configurations can be said of a liquid crystal drive device CRL described later with reference to FIG. 4 if the same is adopted in place of the liquid crystal drive device CRL in FIG. 1.

Figure 2:
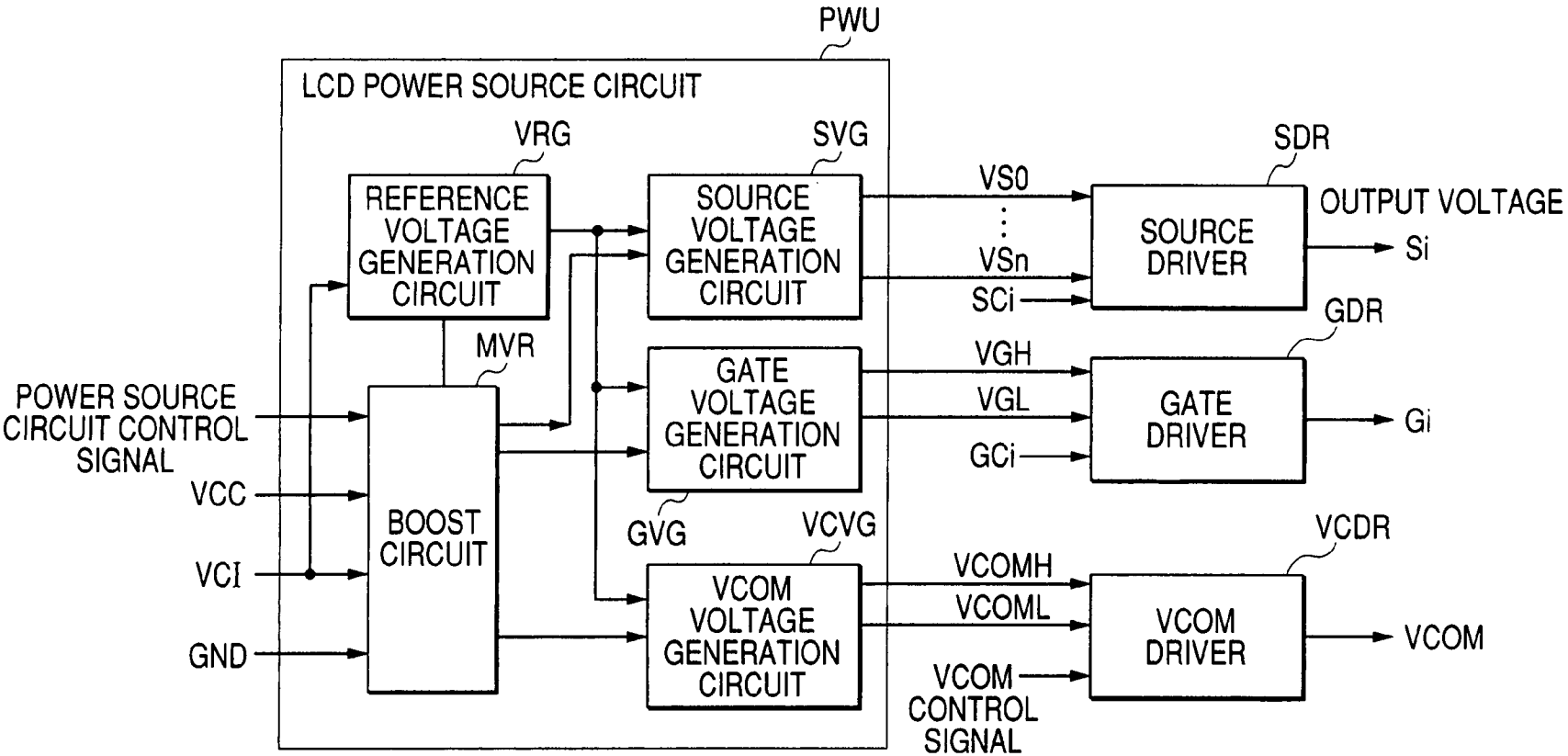
FIG. 2 is a block diagram showing one configuration example of an LCD power source circuit PWU in FIG. 1.

FIG. 2 is a block diagram showing one configuration of the LCD power source circuit PWU in FIG. 1 by way of example. The LCD power source circuit PWU comprises a boost circuit MVR, a reference voltage generation circuit VRG, a source voltage generation circuit SVG, a gate voltage generation circuit GVG, and a common electrode voltage generation circuit (VCOM voltage generation circuit) VCVG. The power source circuit control signal delivered from the driver control circuit DRCR, the first reference voltage VCC, the second reference voltage GND, and the third reference voltage VCI are delivered to the input side of the boost circuit MVR to be supplied thereto. Further, the third reference voltage VCI is supplied to the reference voltage generation circuit VRG as well, and a reference voltage from the reference voltage generation circuit VRG is given to the source voltage generation circuit SVG, the gate voltage generation circuit GVG, and the common electrode voltage generation circuit VCVG.

Based on the reference voltage delivered from the reference voltage generation circuit VRG, and voltages boosted by the boost circuit MVR, the source voltage generation circuit SVG, the gate voltage generation circuit GVG, and the common electrode voltage generation circuit VCVG give source voltages VSO to Vsn, gate voltages VGH, VGL, VCOM voltages VCOMH, VCOML to the source driver SDR, the gate driver GDR, and the VCOM driver VCDR, respectively. Based on the source voltages VS0 to Vsn as received and the source control signal Sci from the driver control circuit DRCR, the source driver SDR sends out the display data Si to the source electrode interconnects. Based on the gate voltages VGH, VGL as received and the gate control signal Gci, the gate driver GDR sends out the scanning signal Gi to the gate electrode interconnects. Then, based on the VCOM voltages VCOMH, VCOML and the VCOM control signal, the VCOM driver VCDR sends out the common voltage VCOM that is a common electrode potential (common potential) to the common electrode interconnects.

Figure 3:
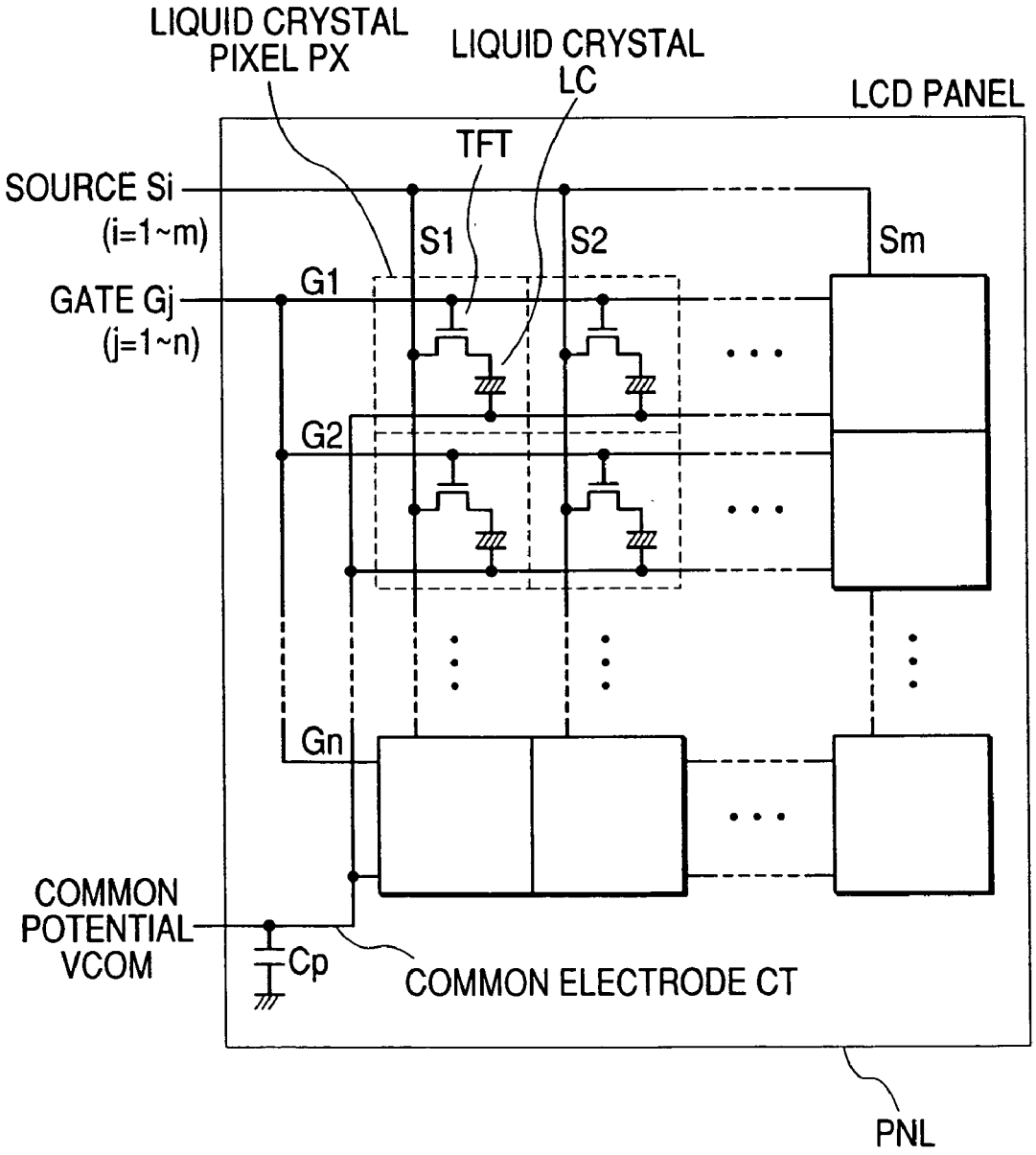
FIG. 3 is an equivalent circuit diagram of one configuration example of a liquid crystal display panel PNL of the active-matrix type.

FIG. 3 is an equivalent circuit diagram of one configuration example of a liquid crystal display panel PNL of the active-matrix type. The liquid crystal display panel PNL denoted by LCD panel has a plurality of source electrode interconnects S1, S2, . . . Sm, extending in a first direction (longitudinal direction) and juxtaposed in a second direction (transverse direction) intersecting the first direction, a plurality of gate electrode interconnects G1, G2, . . . Gm, extending in the second direction and juxtaposed in the first direction, and a plurality of common electrode interconnects extending in the second direction and juxtaposed in the first direction. The plurality of common electrode interconnects are coupled in common to the common electrode CT, and the common electrode CT serves as the external terminal.

The LCD panel has a thin-film transistor TFT constituting a pixel at respective crossover points of the source electrode interconnects S1, S2, . . . Sm, and the gate electrode interconnects G1, G2, . . . Gm, and the respective gate electrode interconnects are coupled to respective gate electrodes of the thin-film transistors TFTs while the respective source electrode interconnects are coupled to respective source electrodes (or drain electrodes) of the thin-film transistors TFTs. The respective drain electrodes (or source electrodes) of the thin-film transistors TFTs are coupled to respective pixel electrodes serving as electrodes on one side of respective liquid crystal cells. Electrodes on the other side of the respective liquid crystal cells, that is, the common electrodes are coupled to the common electrode interconnects coupled to the common electrode CT serving as the external terminal. In FIG. 3, a portion surrounding each of the thin-film transistors TFTs and the liquid crystal cell corresponds to one of the pixels. The pixels are two-dimensionally arranged in m-columns by n-rows, thereby constituting a display region (pixel region). Reference numeral Cp indicates a load capacitance of the display panel PNL.

Figure 4:
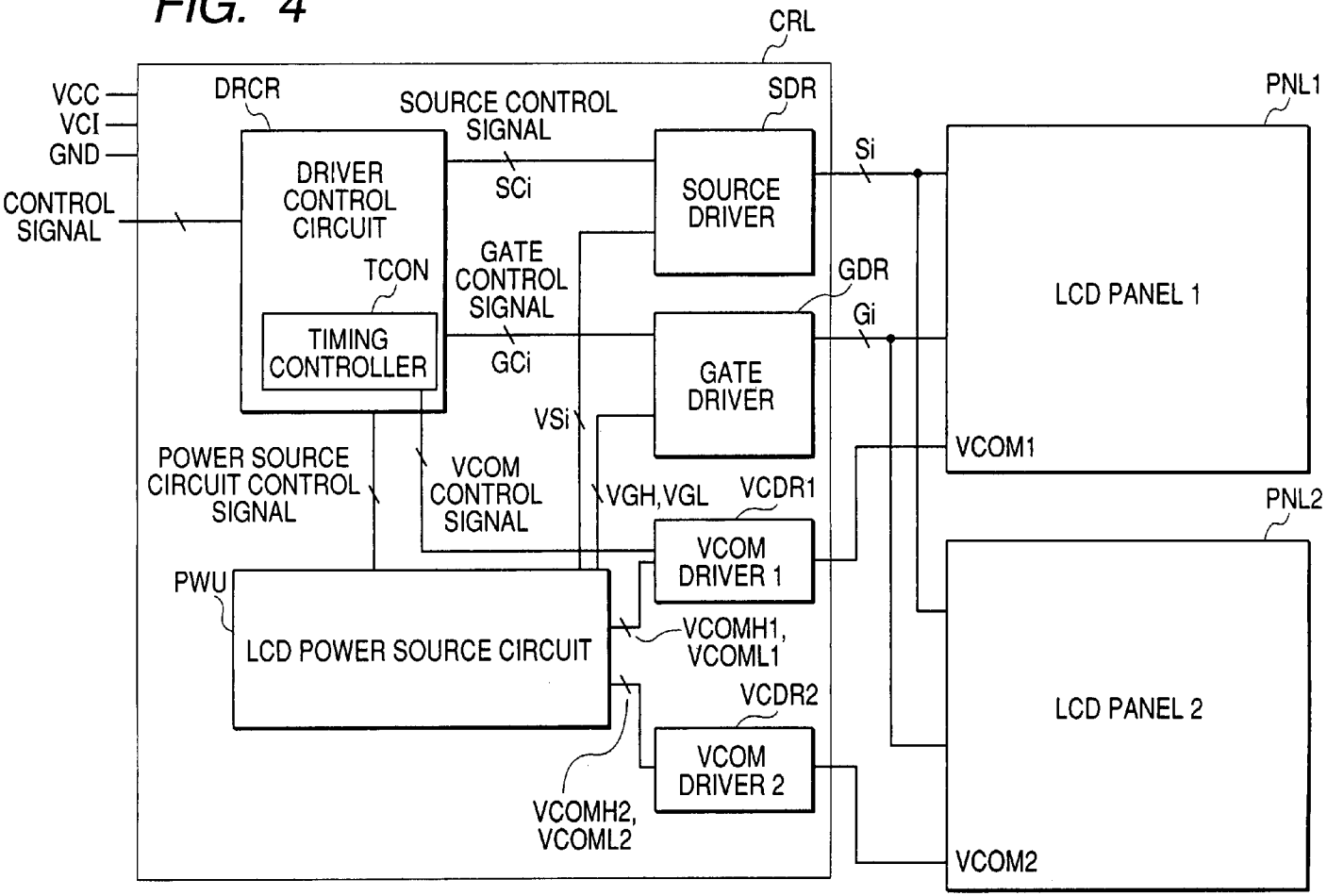
FIG. 4 is a block diagram showing another configuration of an embodiment of a liquid crystal drive device according to the invention.

FIG. 4 is a block diagram showing another configuration of an embodiment of a liquid crystal drive device according to the invention by way of example.

A liquid crystal drive device CRL shown in FIG. 4 has a configuration for driving two sheets of liquid crystal display panels, that is, a first liquid crystal display panel PNL1 (LCD panel 1) and a second liquid crystal display panel PNL2 (LCD panel 2). The liquid crystal drive device CRL is the same in basic configuration as that shown in FIG. 1. With this configuration, however, there are provided two VCOM drivers, that is, VCOM driver 1 and VCOM driver 2, corresponding to the first liquid crystal display panel PNL1 and second liquid crystal display panel PNL2, respectively. First VCOM voltages VCOMH1, VCOML1, and second VCOM voltages VCOMH2, VCOML2 are delivered from a LCD power source circuit PWU to the VCOM drivers VCOM1, VCOM2, respectively, and based on these VCOM voltages as delivered, the respective VCOM voltages are sent out to VCOM voltage inputs VCOM1 and VCOM2 of the first liquid crystal display panel PNL1 and second liquid crystal display panel PNL2, respectively. Source electrode interconnects and gate electrode interconnects are shared by the first liquid crystal display panel PNL1 and second liquid crystal display panel PNL2.

Figure 5:
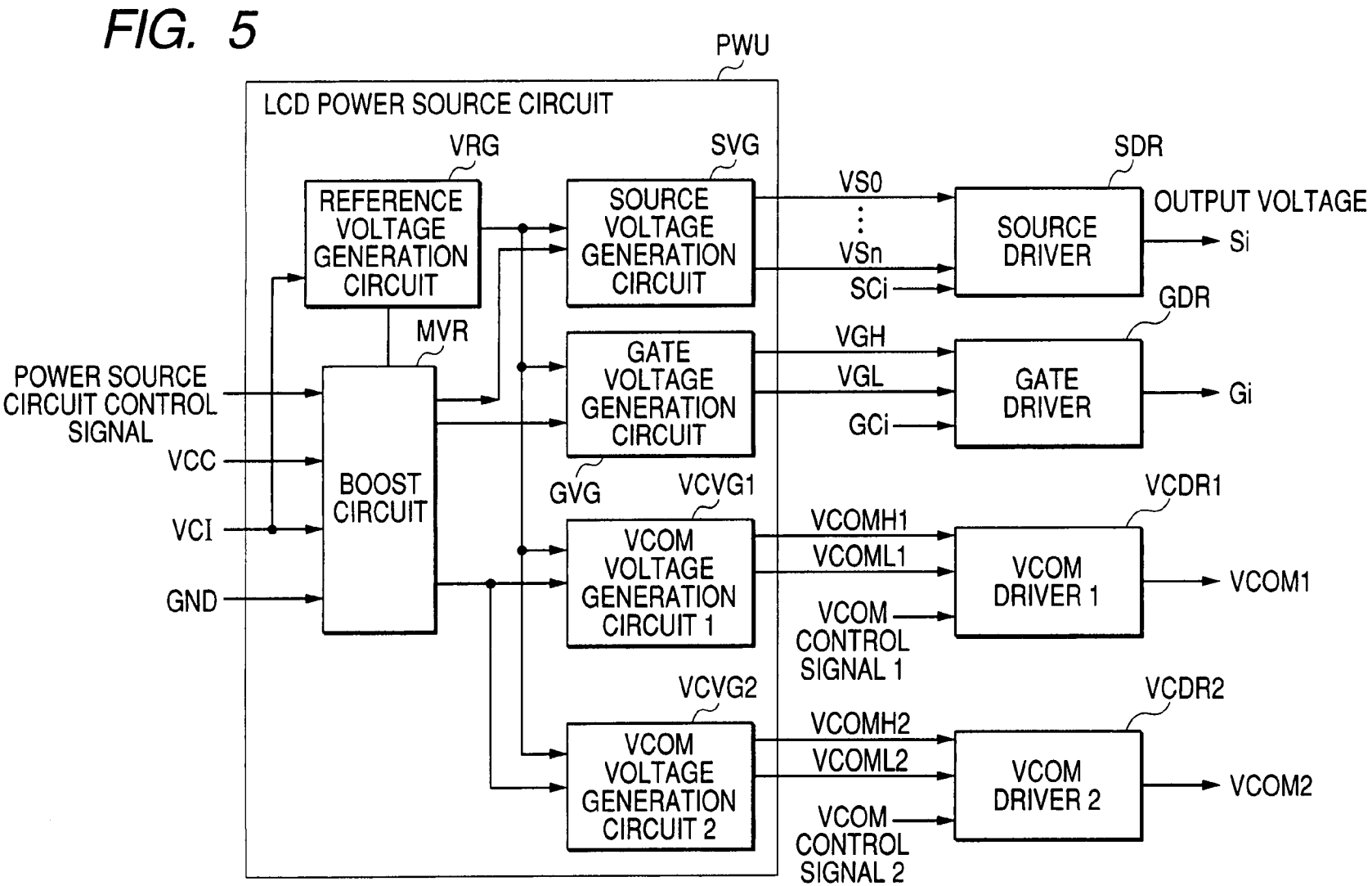
FIG. 5 is a block diagram showing another configuration example of an LCD power source circuit PWU in FIG. 4.

FIG. 5 is a block diagram showing another configuration of an LCD power source circuit PWU in FIG. 4 by way of example. This LCD power source circuit PWU has common electrode voltage generation circuits VCVG1, VCVG2, corresponding to the first liquid crystal display panel PNL1 and second liquid crystal display panel PNL2, respectively. The common electrode voltage generation circuits VCVG1, VCVG2 send out first VCOM voltages VCOMH1, VCOML1, and second VCOM voltages VCOMH2, VCOML2 to VCOM drivers VCDR1 for the first liquid crystal display panel PNL1, and VCDR2 for the second liquid crystal display panel PNL2, respectively. Otherwise, the LCD power source circuit PWU is the same in configuration and operation as that in FIG. 2.

Figure 6:
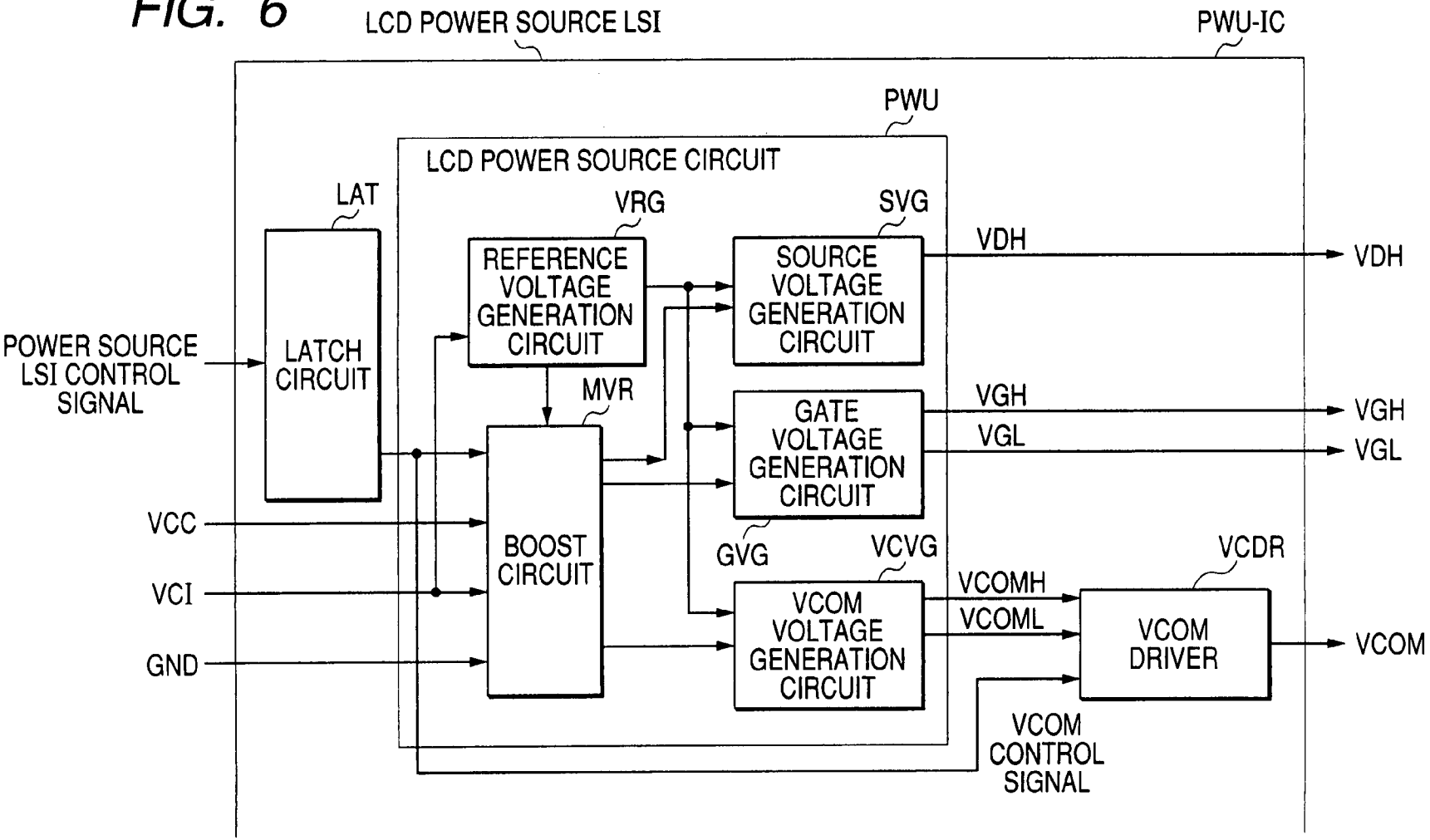
FIG. 6 is a block diagram showing still another configuration example of an LCD power source circuit PWU of an embodiment of a liquid crystal drive device according to the invention, for a liquid crystal display device having one sheet of liquid crystal display panel.

FIG. 6 is a block diagram showing still another configuration example of an LCD power source circuit PWU of an embodiment of a liquid crystal drive device according to the invention, for a liquid crystal display device having one sheet of liquid crystal display panel. While the liquid crystal drive device shown in FIG. 1 by itself is integrated on one piece of LSI chip, a VCOM driver VCDR in FIG. 6, together with the LCD power source circuit PWU, is accommodated by one piece of LSI chip for a PWU-IC. Accordingly, the operation of the LCD power source circuit PWU is the same as that described with reference to FIG. 2. By integrating the VCOM driver VCDR with the LCD power source circuit PWU in such a way, reduction in mounting space of the liquid crystal display device can be achieved.

Figure 7:
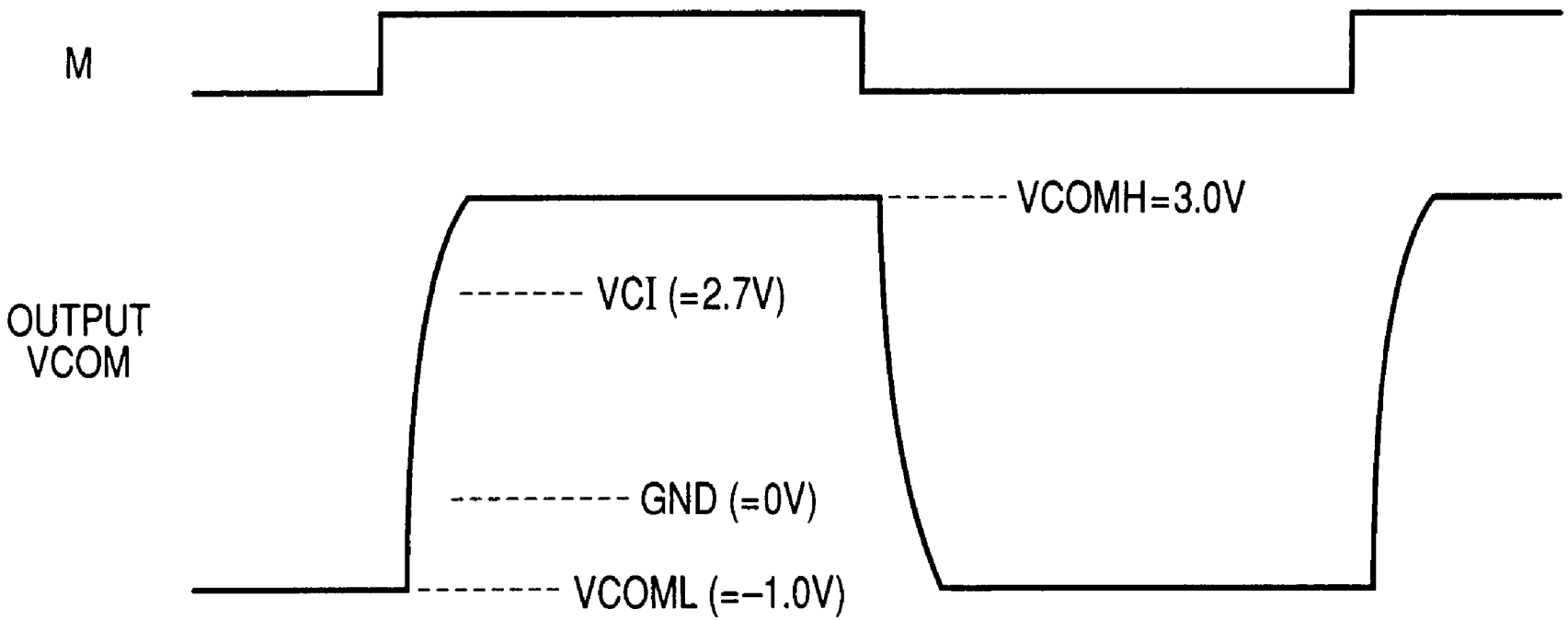
FIG. 7 is an operation waveform chart of a conventional VCOM driver VCDR.

The operation of the liquid crystal drive device according to the invention is described in detail hereinafter in contrast with the conventional technology. FIG. 7 is an operation waveform chart of a conventional VCOM driver VCDR. In FIG. 7, a signal M is a VCOM AC-conversion signal, and depending on the signal M, an output VCOM signal level, as shown in FIG. 7, is determined.

In FIG. 7, the output VCOM is at a L-level (the second voltage VCOML) when the signal M is at a L-level, and the output VCOM is at a H-level (the first voltage VCOMH) when the signal M is at a H-level. In FIG. 7, it is shown by way of example that the second voltage VCOML is at −1.0V, the first voltage VCOMH is at 3.0V, and the third reference voltage VCI is at the ground potential (GND=0V).

In the operation mode, the output VCOM is charged to the level of the first voltage VCOMH upon transition of the signal M form the L-level to the H-level.

Upon transition of the signal M form the H-level to the L-level, the output VCOM is charged to the level of the second voltage VCOML. The same operation is thereafter repeated.

Thus, with the conventional VCOM driver, the output VCOM undergoes charging operations (charging operation/discharging operation) between the first voltage VCOMH and the second voltage VCOML, so that power consumption at this point in time is large. Accordingly, there is a limitation to an extent of reduction in power consumption of a liquid crystal display device as a whole.

Figure 8:
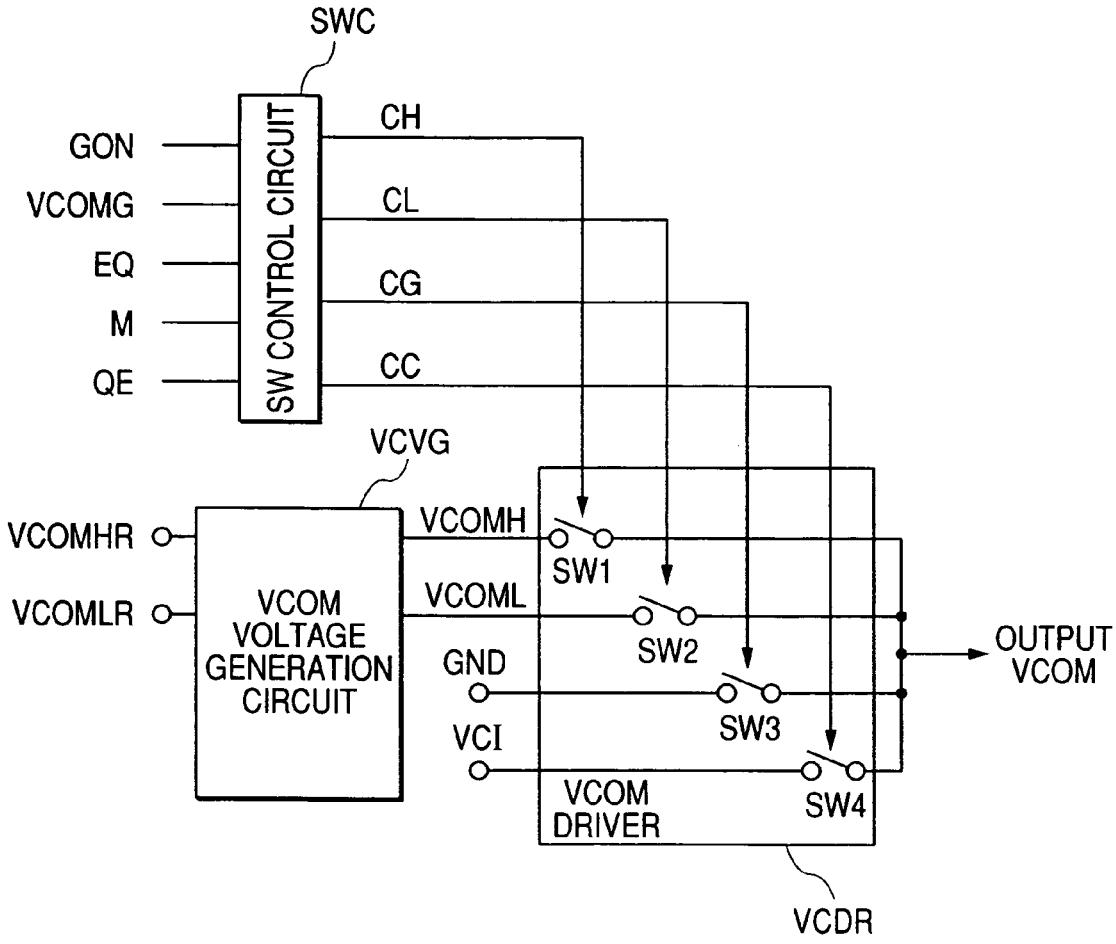
FIG. 8 is a schematic illustration showing the principal part of a configuration example of a VCOM driver VCDR according to the invention.
Figure 9:
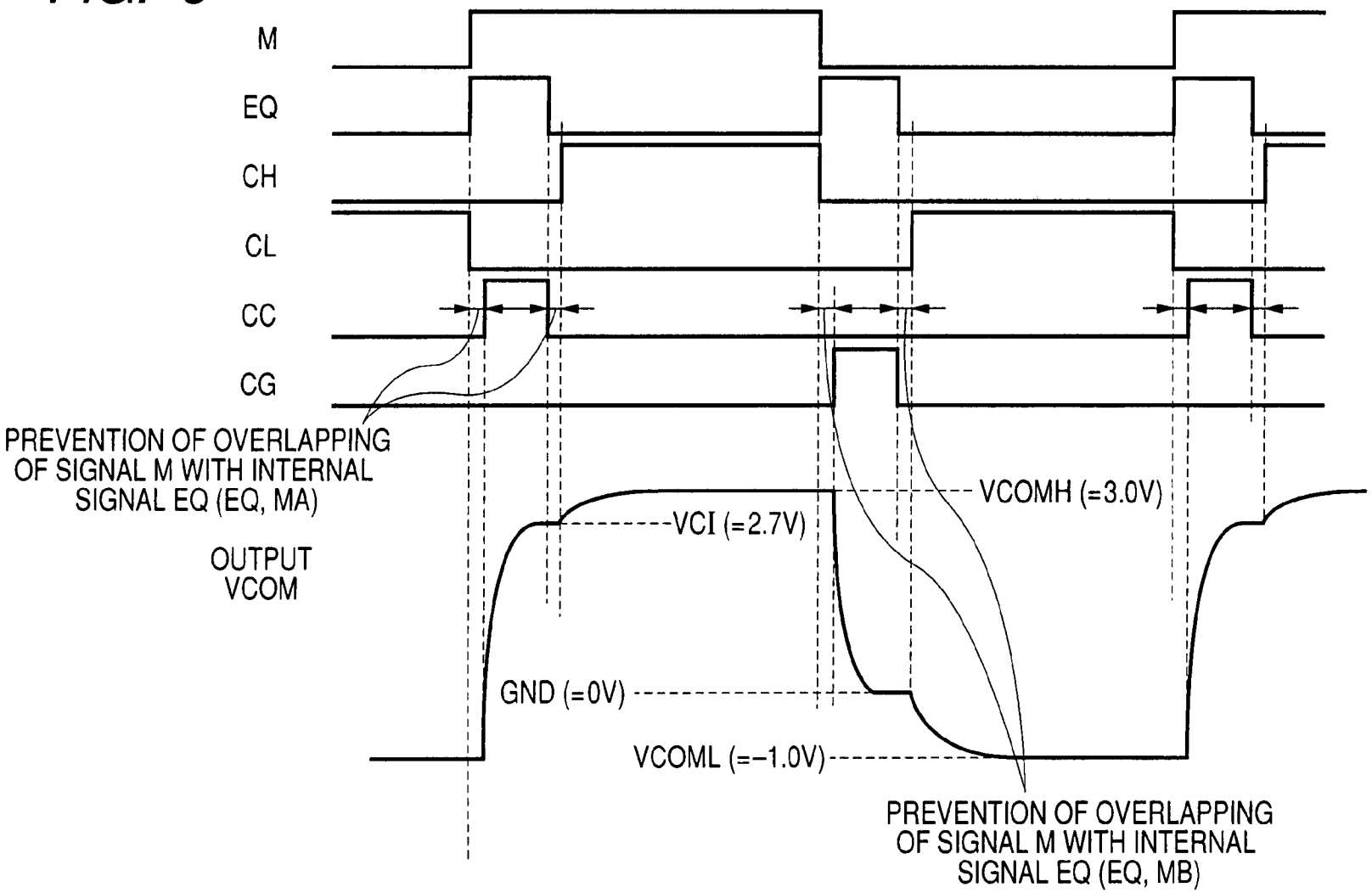
FIG. 9 is an operation waveform chart of the VCOM driver VCDR shown FIG. 8.

FIG. 8 is a schematic illustration showing the principal part of a configuration example of the VCOM driver VCDR according to the invention. FIG. 9 is an operation waveform chart of the VCOM driver VCDR shown FIG. 8. In FIG. 8, a first voltages VCOMH, and a second voltage VCOML are sent out from the VCOM voltage generation circuit VCVG to be coupled to a first switch SW1, and a second switch SW2, provided between the VCOM voltage generation circuit VCVG and the output VCOM to the common electrode driver VCDR, respectively. Further, there are provided a third switch SW3 between the front stage of the output VCOM and the ground potential GND, and a fourth switch SW4 between the front stage of the output VCOM and the third reference voltage VCI. Those switches SW1 to SW4 are opened and closed by switch control signals CH, CL, CG, CC, sent out from a switch control circuit (SW control circuit) SWC, respectively.

A signal GON is a gate-on (display enable) signal, the signal M is the VCOM AC-conversion signal, and VCOMG is a level select signal of the second voltage VCOML at a time when VCOM is converted into AC. An oscillation operation between VCOM=the first voltage VCOMH and the ground potential GND is executed at VCOMG=0 while an oscillation operation between VCOM=the first voltage VCOMH and the second voltage VCOML is executed at VCOMG=1. A signal EQ is a timing signal (control signal) for pre-charging the output VCOM with the third reference voltage VCI or the ground potential GND. The signals GON, M, EQ, and VCOMG, respectively, are delivered from the timing controller TCON. Further, a signal QE is a control signal for effecting the operation of the present invention by presetting it at a H-level, and is not directly associated with operation timing. Accordingly, in case that the signal QE is at a L-level, it is obvious that the operation can be effected according to the conventional operation.

The operation in FIG. 8 is described hereinafter with reference to FIG. 9. First, when the signal M is at the L-level, the output VCOM is at the L-level, when the signal M is at the H-level, the output VCOM is at the H-level, and with the control signal EQ at a H-level, the VCOM driver VCDR according to the present configuration example will be in the operation mode. In case that the control signal EQ is at the L-level, the VCOM driver VCDR is obviously in the operation mode described with reference to FIG. 7.

At a timing of the signal M making a L-level to H-level transition, the control signal EQ makes a L-level to H-level transition. At this point in time, the switch control signal CL of the switch SW2 for the output VCOM makes a H-level to L-level transition. That is, with the switch control signal CL at the L-level, the switch SW2 becomes nonconducting, so that the output VCOM is cut off from VCOML as the output of the VCOM voltage generation circuit VCVG, and is in high impedance state. Thereafter, the switch control signal CC of the switch SW4 is caused to makes a L-level to H-level transition at a timing delayed from the transition of the control signal EQ form the L-level to the H-level. Such delay is intended to prevent the rising edge and falling edge of the switch control signal CC from overlapping with the rising edge and falling edge of the control signal EQ, respectively, as shown in FIG. 9.

With this arrangement, it is possible to prevent current from the third reference voltage VCI from flowing into VCOML, due to concurrent drop of respective impedances at the switches SW2, and SW4, thereby enabling power consumption to be suppressed. Because lines (VCOMH, VCOML, GND, VCI, in FIG. 8) of the VCOM voltage generation circuit for generating voltages for driving a liquid crystal display panel are low in output impedance and large in driving force, short-circuiting therebetween should be avoided as much as possible. When the switch control signal CC is at the H-level, the output VCOM is coupled to the third reference voltage VCI, so that the output VCOM is charged toward the level of the third reference voltage VCI.

With the elapse of a predetermined time controlled by the timing controller TCON (refer to FIG. 1), the control signal EQ makes a H-level to L-level transition. At this point in time, the switch control signal CC of the switch SW4 makes a H-level to L-level transition, thereby cutting off the output VCOM from the third reference voltage VCI. At a timing delayed from the H-level to L-level transition of the switch control signal CC, the switch control signal CH of the switch SW1 makes a L-level to H-level transition. Such delay is intended to suppress an increase in power consumption, due to concurrent drop of respective impedances at the switches SW4 and SW1. That is, when the switch control signal CH of the switch SW1 is at the H-level, the switch SW1 becomes conducting, so that the output VCOM is coupled to VCOMH of the VCOM voltage generation circuit VCVG, and is charged to the level of VCOMH.

At a timing of the signal M making a H-level to L-level transition, the control signal EQ makes a L-level to H-level transition as in the previously-described case. At this point in time, the switch control signal CH of the switch SW1 for the output VCOM makes a H-level to L-level transition. That is, with the switch control signal CH at the L-level, the switch SW1 becomes nonconducting, so that the output VCOM is cut off from VCOMH of the VCOM voltage generation circuit VCVG, and is in high impedance state.

Thereafter, the switch control signal CG of the switch SW3 is caused to make a L-level to H-level transition at a timing delayed from the transition of the control signal EQ form the L-level to the H-level. Such delay is intended to suppress an increase in power consumption, due to concurrently drop of respective impedances at the switches SW1, and SW3. When the switch control signal CG is at the H-level, the output VCOM is coupled to the ground potential GND, so that the output VCOM is charged toward the ground potential GND (actually discharging operation).

With the elapse of a predetermined time controlled by the timing controller TCON, the control signal EQ makes a H-level to L-level transition. At this point in time, the switch control signal CG makes a H-level to L-level transition, thereby cutting off the output VCOM from the ground potential GND. At a timing delayed from the H-level toL-level transition of the switch control signal CG, the switch control signal CL of the switch SW2 makes a L-level to H-level transition. Such delay is intended to suppress an increase in power consumption, due to concurrent drop of respective impedances at the switches SW2 and SW1. That is, when the switch control signal CL of the switch SW2 is at the H-level, the switch SW2 becomes conducting, so that the output VCOM is coupled to VCOML of the VCOM voltage generation circuit VCVG, and is charged to the level of VCOML. Thereafter, the same operation is repeated.

Figure 10:
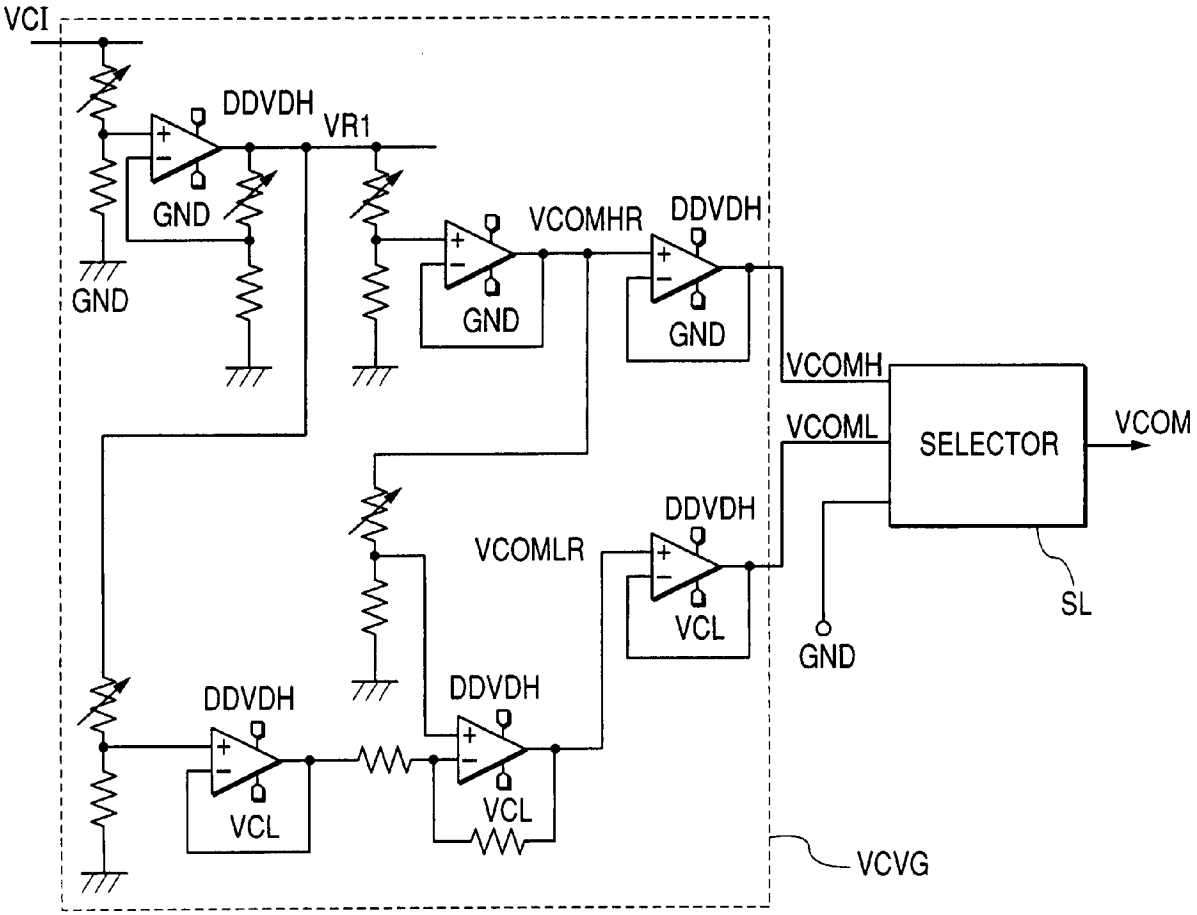
FIG. 10 is a block diagram showing a conventional VCOM voltage output circuit.

In FIG. 10, the VCOM voltage generation circuit VCVG is operated on the basis of the third reference voltage VCI applied from outside and the voltage of the ground potential GND. On the output side of the VCOM voltage generation circuit VCVG, op-amps outputting the first voltage VCOMH and the second voltage VCOML, respectively, and GND are coupled to a selector SL for selecting VCOMH, VCOML, and the ground potential GND. Constituent elements of the VCOM voltage generation circuit VCVG are those op-amps as shown in the figure, representing an example. In the figure, DDVDH denotes a first booster voltage in FIG. 13, described later, VCL a second booster voltage in FIG. 13, VCOMHR a reference voltage of VCOMH, and VCOMLR a reference voltage of VCOML.

Figure 11:
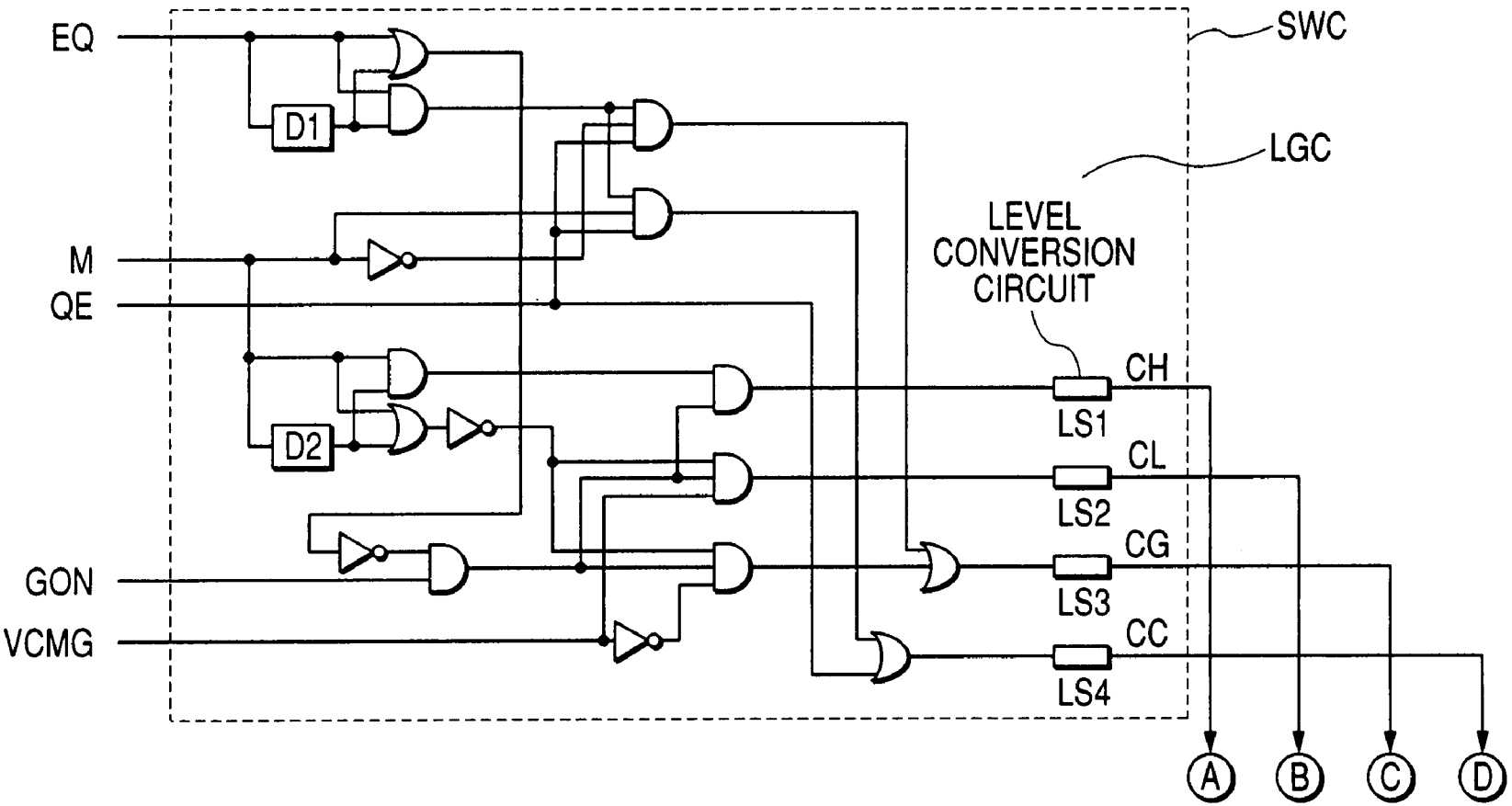
FIG. 11 is a block diagram of an SW control circuit SWC described with reference to FIG. 8.
Figure 12:
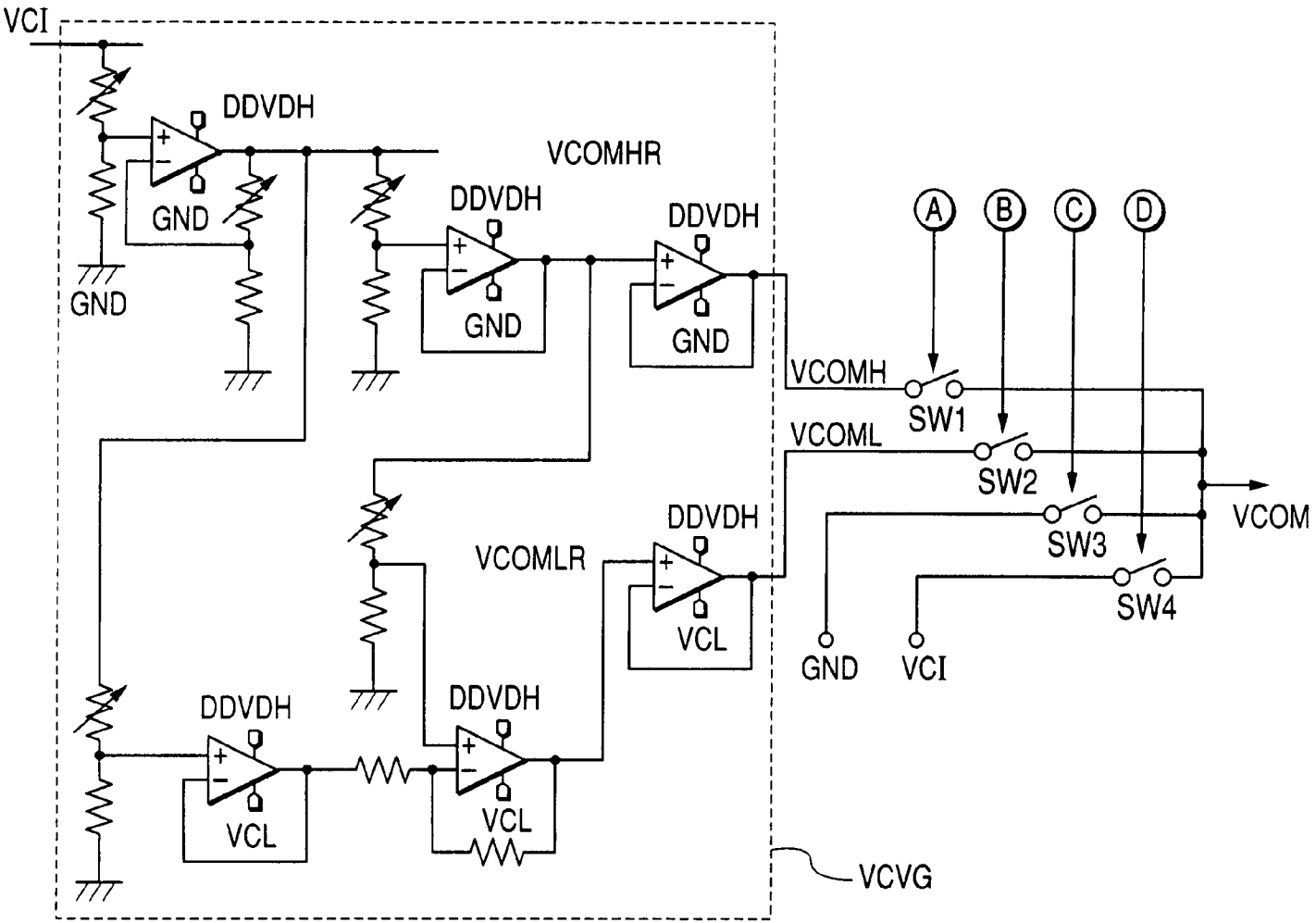
FIG. 12 is a block diagram showing a VCOM voltage generation circuit VCVG and the switch circuit provided on the output side thereof, described with reference to FIG. 8.

FIGS. 11 and 12 each are schematic illustrations of a circuit example of the VCOM driver according to the invention. FIG. 11 is a block diagram of the SW control circuit SWC described with reference to FIG. 8, and FIG. 12 is a block diagram of the VCOM voltage generation circuit VCVG and the switch circuit provided on the output side thereof, also described with reference to FIG. 8. The SW control circuit SWC in FIG. 11 comprises a logic circuit LGC for carrying out logical operation of the signal M, signal GON as the gate-on signal, VCOMG as the level select signal of the second voltage VCOML at the time when VCOM is converted into AC, signal EQ, and signal QE (the signal for enabling the operation of the present invention by concurrent use of the signal EQ, effecting the operation of the present invention when QE is at the L-level and the EQ signal at the H-level), and level conversion circuits LS1, LS2, LS3, and LS4, for converting output levels of the logic circuit LGC.

In FIG. 12, the VCOM voltage generation circuit VCVG is operated on the basis of the third reference voltage VCI applied from outside and the ground potential GND as with the case shown in FIG. 10. On the output side of the VCOM voltage generation circuit VCVG, op-amps outputting the first voltage VCOMH and the second voltage VCOML, respectively, are coupled to the switches SW1, SW2, SW3, and SW4. Constituent elements of the VCOM voltage generation circuit VCVG are those op-amps as shown in the figure, representing an example. The switch SW4 is a switch for opening and closing the third reference voltage VCI. With such a configuration, an effect of reducing power consumption, described hereinafter, can be obtained.

Figure 13:
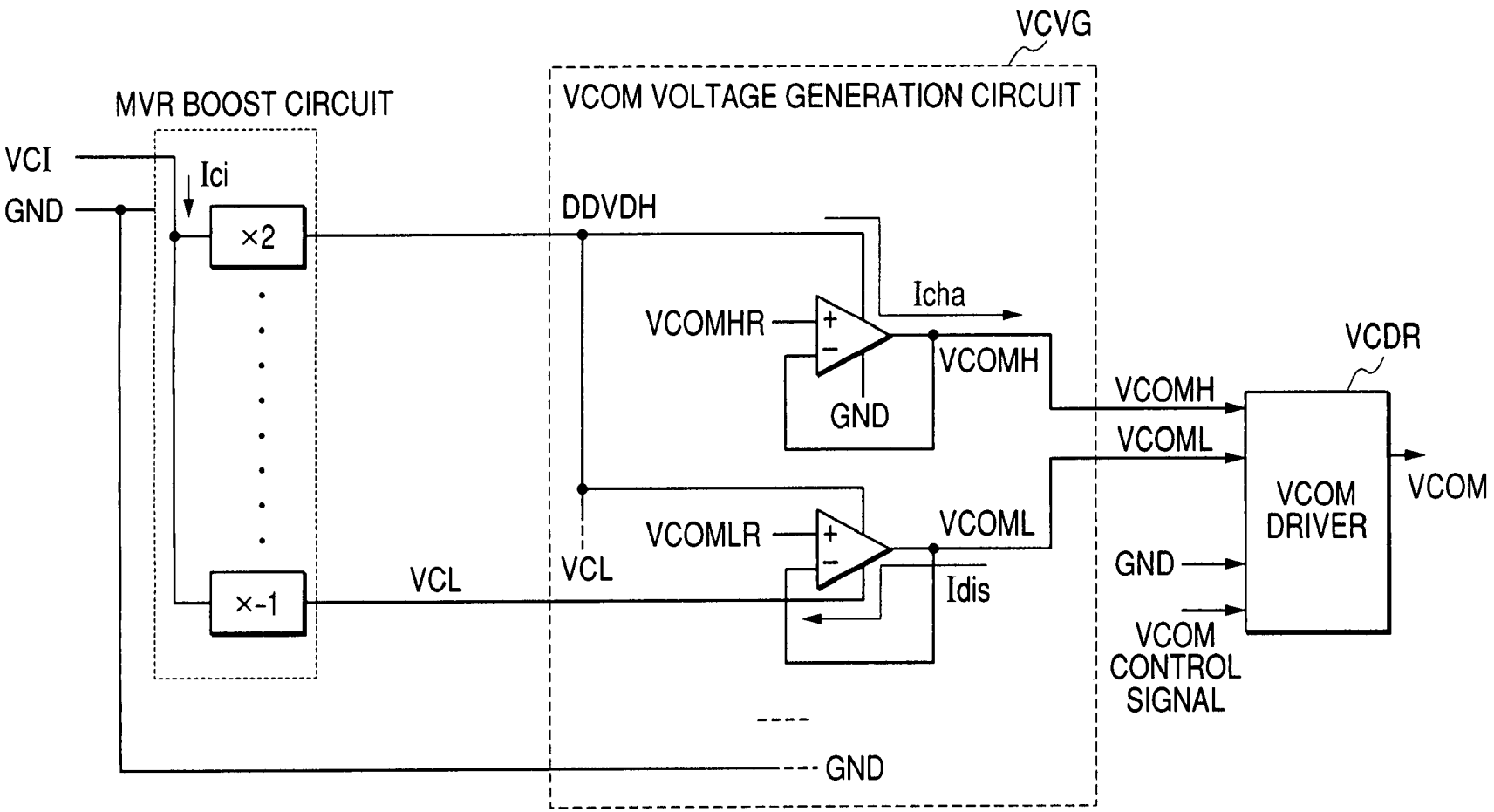
FIG. 13 is a block diagram illustrating a configuration around a VCOM voltage generation circuit of a conventional LCD power source circuit PWU.
Figure 14:
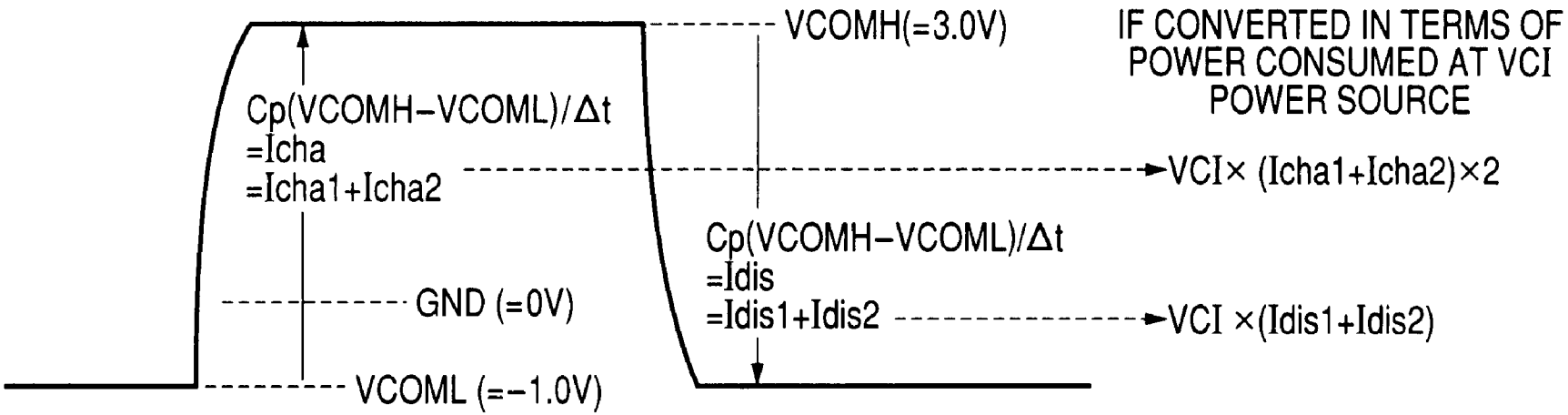
FIG. 14 is a schematic illustration of the operation waveform of VCOM in FIG. 13.

Now, an advantageous effect of the liquid crystal drive device according to the invention is described in contrast with that for the conventional liquid crystal drive device. FIG. 13 is a block diagram illustrating a configuration around a VCOM voltage generation circuit of a conventional LCD power source circuit PWU, and FIG. 14 is a schematic illustration of the operation waveform of VCOM in FIG. 13. A boost circuit MVR comprises multi-stage boosters×2. . . ×−1, supplying boosted voltages to the VCOM voltage generation circuit VCVG. The VCOM voltage generation circuit VCVG comprises an op-amp receiving VCOMHR, and an op-amp receiving VCOMLR, giving a first voltage VCOMH and a second voltage VCOML to a VCOM driver VCDR. The VCOM driver VCDR outputs an output VCOM on the basis of the first voltage VCOMH, the second voltage VCOML, the ground potential GND, and a VCOM control signal received from a timing controller TCON.

From the viewpoint of power supply to the VCOM voltage generation circuit VCVG, the operation waveform in FIG. 14 is described. The VCOM operation waveform shows that charging/discharging is executed between a level of the second voltage VCOML=−1.0V and a level of the first voltage VCOMH=3.0V. A charging current Icha at a time of charging is Cp (VCOMH−VCOML)/Δt where load capacitance of a liquid crystal display panel is Cp, representing the sum of a charging current Icha1 at voltage difference between the third reference voltage VCI and VCOML and a charging current Icha2 from VCI to VCOMH, and if the same is converted in terms of power consumed at the power source of the third reference voltage VCI at this point in time, such converted power is VCI×(Icha1+Icha2)×2 because a current due to two-hold boosting of a current Ici supplied from the third reference voltage VCI becomes the charging current Icha.

Meanwhile, a discharging current Idis at a time of discharging is Cp (VCOMH−VCOML)/Δt, representing the sum of a discharging current Idis1 at voltage difference between VCOMH and the ground potential GND and a discharging current Idis2 at voltage difference between the ground potential GND and VCOML, and in this case, converted power is VCI×(Idis1+Idis2) because a current due to one-hold boosting of the current Ici supplied from the third reference voltage VCI becomes the discharging current Ichis.

Figure 15:
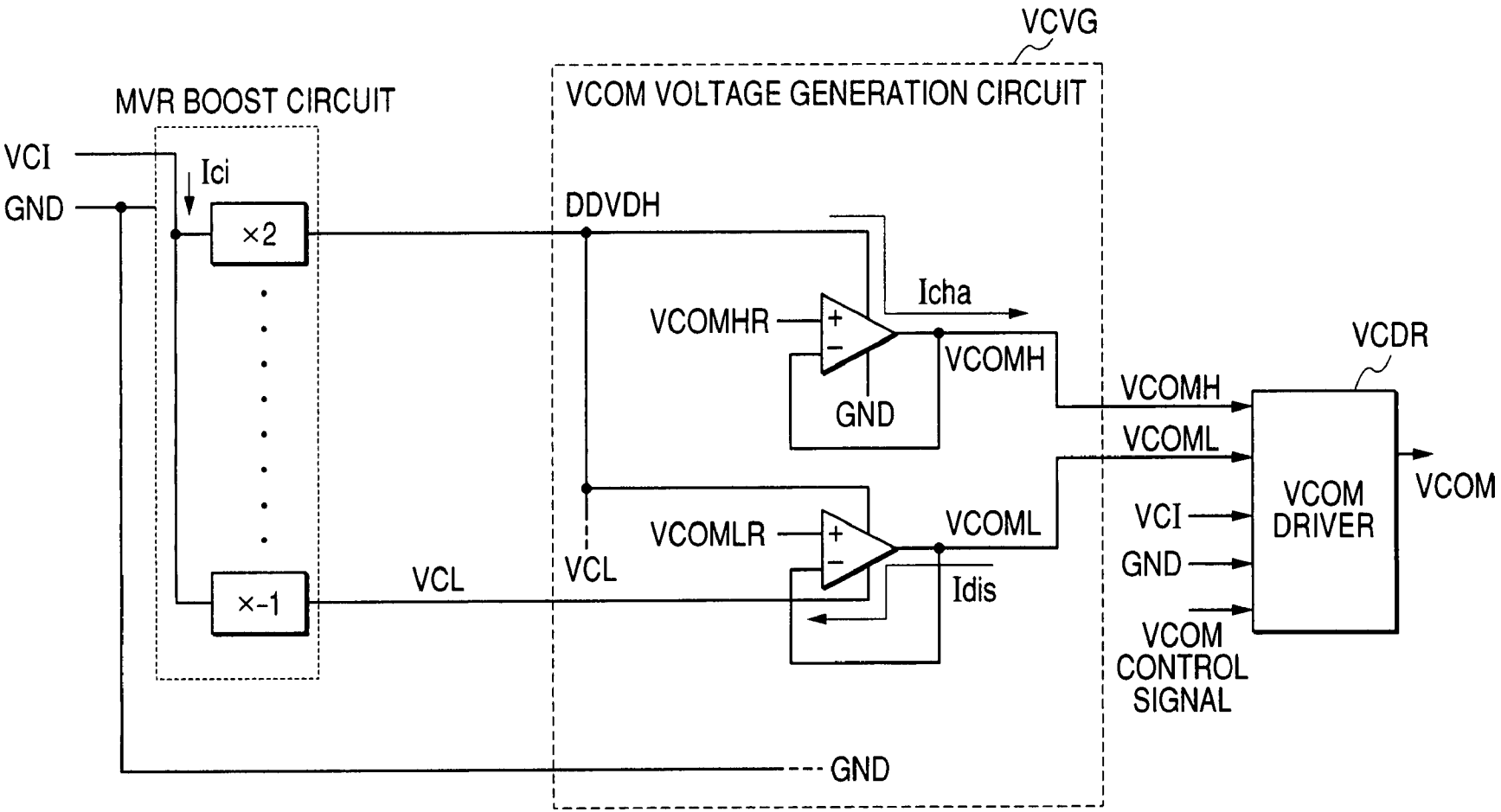
FIG. 15 is a block diagram illustrating a configuration around the VCOM voltage generation circuit of the LCD power source circuit PWU according to the invention.
Figure 16:
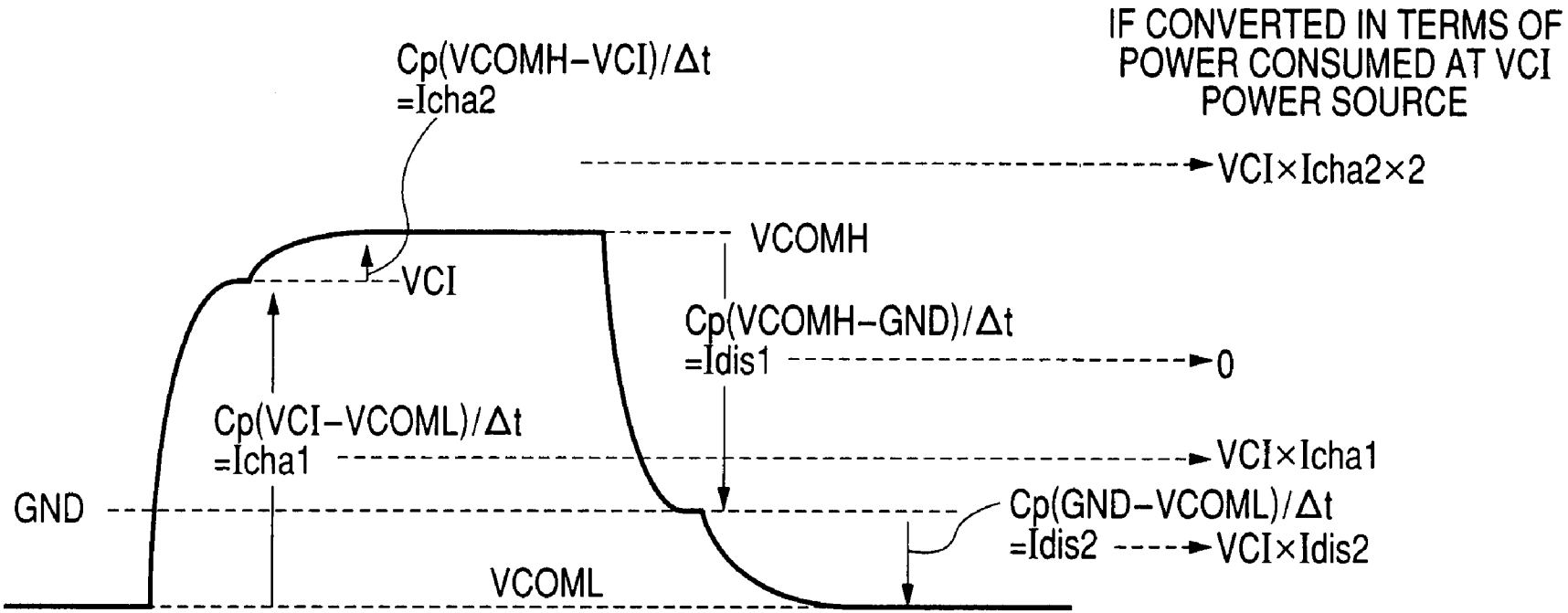
FIG. 16 is a schematic illustration of the operation waveform of VCOM in FIG. 15.

FIG. 15 is a block diagram illustrating a configuration around the VCOM voltage generation circuit of the LCD power source circuit PWU according to the invention, and FIG. 16 is a schematic illustration of the operation waveform of VCOM in FIG. 15. The configuration in FIG. 15 is the same as that in FIG. 13 except that the third reference voltage VCI is added to inputs to the VCOM driver VCDR in FIG. 13. From the view point of power supply to the VCOM voltage generation circuit VCVG with such a configuration, the operation waveform in FIG. 16 is described. The VCOM operation waveform shows that, in the course of charging from the second voltage VCOML to the first voltage VCOMH, a charging current Icha is the sum of a charging current from VCOML to the third reference voltage VCI, Icha1=Cp (VCI−VCOML)/Δt, and a charging current from the third reference voltage VCI to the first voltage VCOMH, Icha2=Cp (VCOMH−VCI)/Δt. Power consumed by Icha1 is the third reference voltage VCI×Icha1, and power consumed by Icha2 is VCI×Icha2×2 because the same is power by a current due to two-hold boosting of the current Ici supplied from the third reference voltage VCI.

Meanwhile, at a time of discharging from the first voltage VCOMH to the second voltage VCOML, a discharging current from the first voltage VCOMH to the ground potential GND, Idis1=Cp (VCOMH−GND)/Δt, and if converted in terms of power consumed at the third reference voltage VCI, power consumption becomes zero because the discharging current is drawn to the ground potential GND. Then, at a time of discharging from the ground potential GND to the second voltage VCOML, a discharging current Idis2=Cp (GND−VCOML)/Δt, being a current due to one-hold boosting of the current Ici supplied from the third reference voltage VCI, so that consumed power in that case as converted is VCI×Idis2.

As is evident from comparison of FIG. 16 with FIG. 14, power consumption of the present invention is noticeably reduced as compared with that for the conventional technology.

Figure 17:
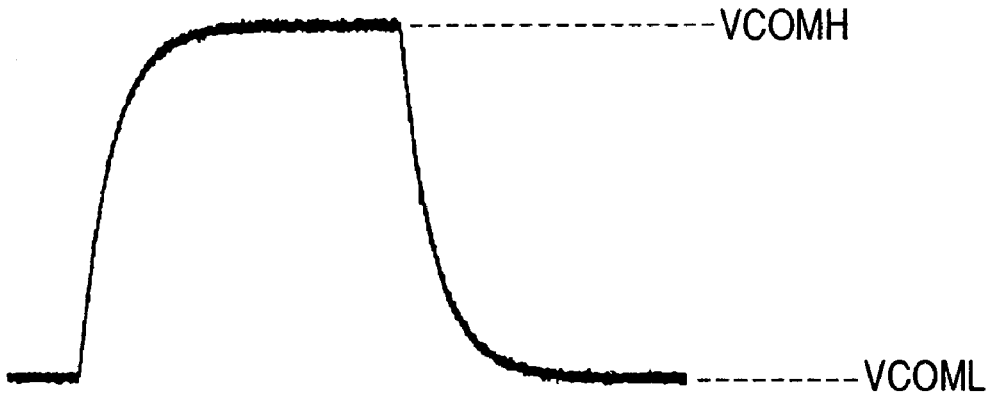
FIG. 17 is a VCOM operation waveform chart in the case of the conventional technology.
Figure 18:
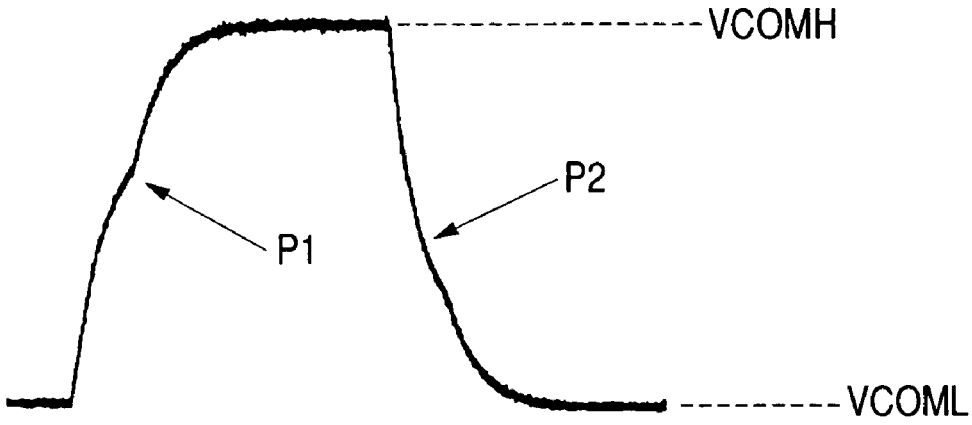
FIG. 18 is a VCOM operation waveform chart in the case of the embodiment of the present invention.

Now, a visually-expressed difference between the operation waveform of VCOM operation according to the present invention and that in the case of the conventional technology, as described in the foregoing, is described hereinafter through comparison. FIG. 17 is a VCOM operation waveform chart in the case of the conventional technology, and FIG. 18 is a VCOM operation wave form chart in the case of the embodiment of the present invention. The VCOM operation waveform in FIG. 17 shows a waveform smoothly rising (charging) or falling (discharging) at any potential point either in a charging process form the second voltage VCOML as a first potential point to the first voltage VCOMH as a second potential point, or in a discharging process form the first voltage VCOMH to the second voltage VCOML.

In contrast, the VCOM operation waveform shown in FIG. 18 has an inflection point P1 at a third potential point corresponding to the third reference voltage VCI, and an inflection point P2 corresponding to the ground potential GND, in a charging process form the second voltage VCOML to the first voltage VCOMH, and in a discharging process form the first voltage VCOMH to the second voltage VCOML, respectively. Thus, it is shown from observation of the VCOM operation waveform that the present invention significantly differs from the conventional technology.

Figure 19:
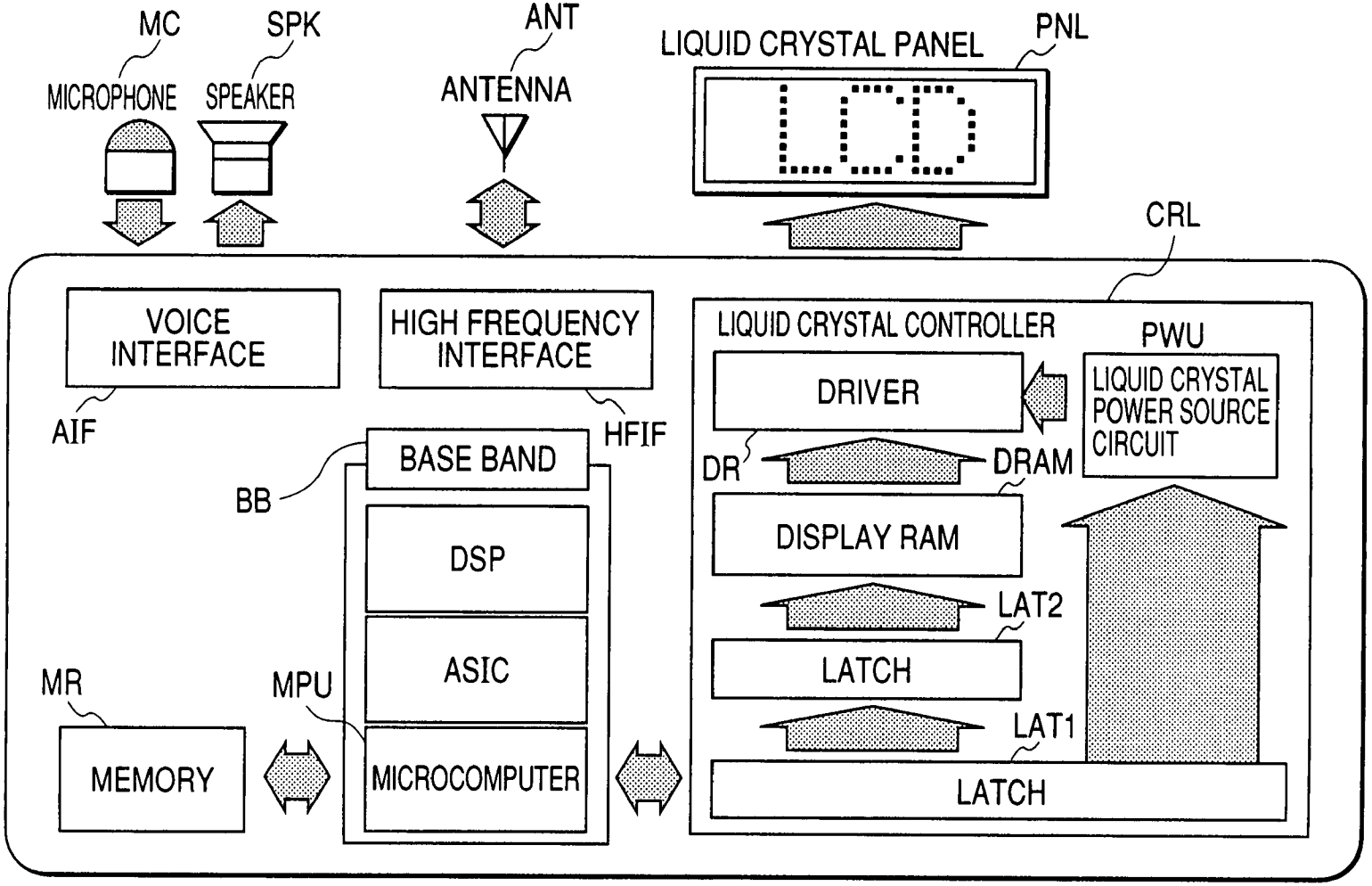
FIG. 19 is a schematic illustration showing a system configuration of a cellular phone as an example of electronic equipment, to which the embodiment of the liquid crystal drive device according to the invention is applied.

FIG. 19 is a schematic illustration showing a system configuration of a cellular phone as an example of electronic equipment, to which the liquid crystal drive device according to the invention is applied. Respective elements of the cellular phone's system are incorporated in an integrated circuit. The system is provided with an voice interface AIF for fetching voice data from an microphone MC, and outputting voice to a speaker SPK, a high frequency interface HFIF for exchanging high frequency data with an antenna ANT, a base band processing circuit BB, a digital signal processing circuit DSP, ASIC, a microcomputer MPU, and a memory MR.

The liquid crystal drive device according to the invention, CRL (denoted by "LC controller" in the figure), comprises latch circuits LAT1, LAT2, for fetching data, a display RAM GRAM, various drivers for supplying a liquid crystal display panel PNL (denoted by "LC panel" in the figure) with display data, scanning signals, and so forth, and a LCD power source circuit PWU (denoted by "LC power source circuit" in the figure). Miniaturization as well as higher function is required of the cellular phone, however, miniaturization makes it difficult to use a large cell, and it is quite difficult to reduce power consumption of the cellular phone due to higher function required thereof. Accordingly, it is essential to reduced power consumption of a liquid crystal drive device. Under the circumstance, by use of the liquid crystal drive device according to the invention, reduction in power consumption can be easily implemented.

There are generally available a line reversal system for reversing the common electrode voltage VCOM for every gate line, and a frame reversal system for reversing the common electrode voltage VCOM for every frame cycle.

With the line reversal system, image quality is excellent but power consumption is large, and conversely, with the frame reversal system, power consumption is small although image quality is not so good. As described hereinbefore, since the present invention has an advantageous effect of reducing power consumption of the VCOM driver, the present invention is particularly effective if applied to the case of the line reversal system among control systems of the common electrode voltage VCOM, and particularly lower power consumption can be achieved by applying the present invention to the VCOM driver during line reversal drive.

When the common electrode voltage VCOM makes a transition from the second voltage VCOML to the first voltage VCOMH, the transition may proceed from VCOML to the ground potential GND and subsequently, to the third reference voltage VCI before finally proceeding to the first voltage VCOMH although not shown in the figures. At a time of the transition from the second voltage VCOML to the ground potential GND, a current flows in from the ground potential GND, so that power consumed is zero as seen from the point of the liquid crystal drive device CRL. Accordingly, current consumed, in the transition from the second voltage VCOML to the third reference voltage VCI, becomes $Cp \times VCI/\Delta t$, as seen from the point of the liquid crystal drive device CRL, and the current consumed is smaller as compared with the case of FIG. 15.

For switch control at this pointing in time, it is preferable to provide a switch control circuit for controlling the switches SW2, SW3, SW4, and SW1, respectively, in operation in FIG. 9, and if a period is provided such that all the other switches are open at a time of switching each of the switches, this will prevent flow of a penetrating current, thereby suppressing power consumption.

Further, the operation waveform of the VCOM operation, at that time, has the inflection point corresponding to the third reference voltage VCI, and the inflection point corresponding to the ground potential GND, in the charging process form the second voltage VCOML to the first voltage VCOMH.

Furthermore, electronic equipment to which the liquid crystal drive device according to the invention is applied is not limited to the cellular phone shown in FIG. 19, and the invention is similarly applicable to a portable terminal such as PDA, and so forth, an electronic book, and various other equipment.

Thus, with the present invention, it is possible to implement reduction in power of the common electrode voltages applied from the power source of the liquid crystal drive device to the common electrode interconnects of a liquid crystal display panel, respectively. Hence, the invention can provide the liquid crystal drive device for use in a liquid crystal display panel, capable of attaining lower power consumption of the liquid crystal display panel as a whole.

What is claimed is:

1. A liquid crystal drive device for supplying various signals and voltages for effecting display on a liquid crystal display panel comprising a plurality of source electrode interconnects extending in a first direction and juxtaposed in a second direction intersecting the first direction, a plurality of gate electrode interconnects extending in the second direction and juxtaposed in the first direction, an active element constituting a pixel at respective crossover points of the source electrode interconnects and the gate electrode interconnects, a plurality of common electrode interconnects disposed through the intermediary of a liquid crystal layer, and an external terminal coupled in common to the common electrode interconnects, said liquid crystal drive device comprising:

a first terminal to which a first reference voltage is supplied;

a second terminal to which a second reference voltage is supplied;

a third terminal to which a third reference voltage is supplied;

a fourth terminal to be coupled to the external terminal of the liquid crystal display panel;

a first voltage generation circuit coupled to the first terminal and the second terminal, for generating a first voltage higher than the first reference voltage; and a second voltage generation circuit coupled to the first terminal and the second terminal, for generating a second voltage lower than the second reference voltage, wherein a voltage supplied to the fourth terminal is changed from the second voltage to the third reference voltage and subsequently, changed from the third reference voltage to the first voltage.

2. A liquid crystal drive device according to claim 1, further comprising:

a first switching element provided between the first voltage generation circuit and the fourth terminal, to be short-circuited when the voltage supplied to the fourth terminal is changed from the second voltage to the third reference voltage;

a second switching element provided between the third terminal and the fourth terminal, to be short-circuited when the voltage supplied to the fourth terminal is changed from the third reference voltage to the first voltage; and a control circuit for controlling the first switching element and the second switching element such that a period when both the first switching element and the second switching element are turned off is provided between a short circuit time of the first switching element and a short circuit time of the second switching element.

3. A liquid crystal drive device according to claim 1, further comprising:

a gate driver for generating a select signal to be supplied to the plurality of gate electrode interconnects for the pixels, respectively; and a source driver for supplying display data to be supplied to the plurality of source electrode interconnects for the pixels, respectively.

4. A liquid crystal drive device according to claim 1, wherein a voltage supplied to the fourth terminal is changed from the second voltage to the second reference voltage, and subsequently, changed to the third reference voltage.

5. A liquid crystal drive device according to claim 1, further comprising:

a first switching element provided between the first voltage generation circuit and the fourth terminal, to be short-circuited when the voltage supplied to the fourth terminal is changed from the second voltage to the first reference voltage;

a second switching element provided between the third terminal and the fourth terminal, to be short-circuited when the voltage supplied to the fourth terminal is changed from the first reference voltage to the first voltage; and a control circuit for controlling the first switching element and the second switching element such that a period when both the first switching element and the second switching element are turned off is provided between a short circuit time of the first switching element and a short circuit time of the second switching element.

6. A liquid crystal drive device according to claim 5, further comprising:

a gate driver for generating a select signal to be supplied to the plurality of gate electrode interconnects for the pixels, respectively; and a source driver for generating display data to be supplied to the plurality of source electrode interconnects for the pixels, respectively.

7. A liquid crystal drive device for supplying various signals and voltages for effecting display on a liquid crystal display panel comprising a plurality of source electrode interconnects extending in a first direction and juxtaposed in a second direction intersecting the first direction, a plurality of gate electrode interconnects extending in the second direction and juxtaposed in the first direction, an active element constituting a pixel at respective crossover points of the source electrode interconnects and the gate electrode interconnects, a plurality of common electrode interconnects disposed through the intermediary of a liquid crystal layer, and an external terminal coupled in common to the common electrode interconnects, said liquid crystal drive device comprising:

a first terminal to which a first reference voltage is supplied;

a second terminal to which a second reference voltage is supplied;

a third terminal to which a third reference voltage is supplied;

a fourth terminal to be coupled to the external terminal of the liquid crystal display panel;

a first voltage generation circuit coupled to the first terminal and the second terminal, for generating a first voltage higher than the first reference voltage; and a second voltage generation circuit coupled to the first terminal and the second terminal, for generating a second voltage lower than the second reference voltage, wherein a voltage supplied to the fourth terminal is changed from the first voltage to the second reference voltage and subsequently, changed from the second reference voltage to the second voltage.

8. A liquid crystal drive device according to claim 7, further comprising:

a first switching element provided between the second terminal and the fourth terminal, to be short-circuited when the voltage supplied to the fourth terminal is changed from the first voltage to the second reference voltage;

a second switching element provided between the second voltage generation circuit and the fourth terminal, to be short-circuited when the voltage supplied to the fourth terminal is changed from the second reference voltage to the second voltage; and a control circuit for controlling the first switching element and the second switching element such that a period when both the first switching element and the second switching element are turned off is provided between a short circuit time of the first switching element and a short circuit time of the second switching element.

9. A liquid crystal drive device according to claim 7, further comprising:

a gate driver for generating a select signal to be supplied to the plurality of gate electrode interconnects for the pixels, respectively; and a source driver for generating display data to be supplied to the plurality of source electrode interconnects for the pixels, respectively.

10. A liquid crystal drive device for supplying various signals and voltages for effecting display on a first liquid crystal display panel and a second liquid crystal display panel, respectively, each comprising a plurality of source electrode interconnects extending in a first direction and juxtaposed in a second direction intersecting the first direction, a plurality of gate electrode interconnects extending in the second direction and juxtaposed in the first direction, an active element constituting a pixel at respective crossover points of the source electrode interconnects and the gate electrode interconnects, a plurality of common electrode interconnects disposed through the intermediary of a liquid crystal layer, and an external terminal coupled in common to the common electrode interconnects, said liquid crystal drive device comprising:

a first terminal to which a first reference voltage is supplied;

a second terminal to which a second reference voltage is supplied;

a third terminal to which a third reference voltage is supplied;

a voltage generation circuit coupled to the first terminal and the second terminal, for generating a first voltage higher than the first reference voltage and a second voltage lower than the second reference voltage;

a first common voltage generation circuit to be coupled in common to a plurality of pixels of the first liquid crystal display panel, for generating a first common voltage;

a second common voltage generation circuit to be coupled in common to a plurality of pixels of the second liquid crystal display panel, for generating a second common voltage;

a fourth terminal for outputting the first common voltage; and a fifth terminal for outputting the second common voltage, wherein the first common voltage generation circuit or the second common voltage generation circuit controls such that the first common voltage or the second common voltage is changed from the second voltage to the third reference voltage, and subsequently, changed from the third reference voltage to the first voltage when the first common voltage generation circuit or the second common voltage generation circuit generates the first common voltage supplied to the fourth terminal or the second common voltage supplied to the fifth terminal.

11. A liquid crystal drive device according to claim 10, wherein the first common voltage generation circuit or the second common voltage generation circuit controls such that the first common voltage or the second common voltage is changed from the first voltage to the second reference voltage and subsequently, changed from the second reference voltage to the second voltage when the first common voltage generation circuit or the second common voltage generation circuit generates the first common voltage supplied to the fourth terminal or the second common voltage supplied to the fifth terminal.

12. A liquid crystal drive device according to claim 11, further comprising:

a first switching element provided between the first common voltage generation circuit and the fourth terminal or the fifth terminal, to be short-circuited when the first common voltage or the second common voltage, supplied to the fourth terminal or the fifth terminal, is changed from the second voltage to the third reference voltage;

a second switching element provided between the third terminal and the fourth terminal or the fifth terminal, to be short-circuited when the first common voltage or the second common voltage, supplied to the fourth terminal or the fifth terminal, is changed from the third reference voltage to the first voltage; and a control circuit for controlling the first switching element and the second switching element such that a period when both the first switching element and the second switching element are turned off is provided between a short circuit time of the first switching element and a short circuit time of the second switching element.

13. A liquid crystal drive device according to claim 12, further comprising:

a third switching element provided between the second terminal and the fourth terminal or the fifth terminal, to be short-circuited when the first common voltage or the second common voltage, supplied to the fourth terminal or the fifth terminal, is changed from the first voltage to the second reference voltage;

a fourth switching element provided between the voltage generation circuit and the fourth terminal or the fifth terminal, to be short-circuited when the first common voltage or the second common voltage, supplied to the fourth terminal or the fifth terminal, is changed from the second reference voltage to the second voltage; and a control circuit for controlling the third switching element and the fourth switching element such that a period when both the third switching element and the fourth switching element are turned off is provided between a short circuit time of the third switching element and a short circuit time of the fourth switching element.

14. A liquid crystal drive device according to claim 10, further comprising:

a gate driver for generating a select signal to be supplied to the plurality of gate electrode interconnects for the pixels, respectively; and a source driver for generating display data to be supplied to the plurality of source electrode interconnects for the pixels, respectively.

15. A liquid crystal drive device according to claim 10, wherein the first common voltage generation circuit or the second common voltage generation circuit controls such that the first common voltage or the second common voltage is changed from the second voltage to the second reference voltage, and subsequently, to the third voltage before changed to the second reference voltage when the first common voltage generation circuit or the second common voltage generation circuit generates the first common voltage or the second common voltage, supplied to the fourth terminal or the fifth terminal.

16. A liquid crystal drive device for supplying various signals and voltages for effecting display on a liquid crystal display panel comprising a plurality of source electrode interconnects extending in a first direction and juxtaposed in a second direction intersecting the first direction, a plurality of gate electrode interconnects extending in the second direction and juxtaposed in the first direction, an active element constituting a pixel at respective crossover points of the source electrode interconnects and the gate electrode interconnects, a plurality of common electrode interconnects disposed through the intermediary of a liquid crystal layer, and an external terminal coupled in common to the common electrode interconnects, said liquid crystal drive device comprising:

a common voltage generation circuit to be coupled to the external terminal for generating common voltages, wherein the common voltage generation circuit forms a voltage waveform having an inflection point at a third potential point between a first potential and a second potential different from the first potential when a potential on the external terminal makes a transition from the first potential to the second potential.

17. A liquid crystal drive device according to claim 16, wherein a voltage at the third potential point is a reference voltage supplied from an external signal source to a drive circuit.

18. A liquid crystal drive device according to claim 16, wherein the first potential is a potential lower than the second potential, the third potential is higher than the first potential but lower than the second potential, and a voltage waveform having an inflection point between the first potential and the third potential is formed upon potential transition from the first potential to the third potential.

19. A liquid crystal drive device outputting potentials to be supplied to common electrodes of a liquid crystal display panel, respectively, wherein the respective common voltages form a voltage waveform having an inflection point in the vicinity of a third potential point between a first potential and a second potential different from the first potential when a potential on an external terminal makes a transition from the first potential to the second potential.

20. A liquid crystal drive device for supplying various signals and voltages for effecting display on a liquid crystal display panel comprising a plurality of source electrode interconnects extending in a first direction and juxtaposed in a second direction intersecting the first direction, a plurality of gate electrode interconnects extending in the second direction and juxtaposed in the first direction, an active element constituting a pixel at respective crossover points of the source electrode interconnects and the gate electrode interconnects, a plurality of common electrode interconnects disposed through the intermediary of a liquid crystal layer, and an external terminal coupled in common to the common electrode interconnects, said liquid crystal drive device being formed over a single semiconductor substrate; and comprising:

a first terminal to which a first reference voltage is supplied;

a second terminal to which a second reference voltage is supplied;

a third terminal to be coupled to the external terminal of the liquid crystal display panel;

a first voltage generation circuit coupled to the first terminal and the second terminal, for generating a first voltage higher than the first reference voltage; and a second voltage generation circuit coupled to the first terminal and the second terminal, for generating a second voltage lower than the second reference voltage, wherein a voltage supplied to the third terminal is changed from the second voltage to the first reference voltage, and subsequently, changed from the first reference voltage to the first voltage.

* * * * *